US007238868B2

(12) United States Patent
Muramatsu et al.

(10) Patent No.: US 7,238,868 B2
(45) Date of Patent: Jul. 3, 2007

(54) KEYBOARD MUSICAL INSTRUMENT EQUIPPED WITH AUTOMATIC PLAYER AND METHOD FOR RETROFITTING KEYBOARD MUSICAL INSTRUMENT

(75) Inventors: Shigeru Muramatsu, Shizuoka-ken (JP); Kiyoshi Kawamura, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 189 days.

(21) Appl. No.: 10/616,167

(22) Filed: Jul. 9, 2003

(65) Prior Publication Data

US 2004/0025674 A1 Feb. 12, 2004

(30) Foreign Application Priority Data

Aug. 9, 2002 (JP) ..... 2002-233013

(51) Int. Cl.
*G10F 1/02* (2006.01)

(52) U.S. Cl. ..... 84/20; 84/105

(58) Field of Classification Search ..... 84/12–13, 84/16–23, 25, 27, 29, 105, 107–114
See application file for complete search history.

(56) References Cited

U.S. PATENT DOCUMENTS

| | | | | |
|---|---|---|---|---|
| 340,876 | A * | 4/1886 | Hartling | 84/13 |
| 579,958 | A * | 4/1897 | Clark | 84/16 |
| 848,207 | A * | 3/1907 | Rodesch | 84/29 |
| 5,081,893 | A * | 1/1992 | Broadmoore | 84/19 |

* cited by examiner

*Primary Examiner*—Lincoln Donovan
*Assistant Examiner*—David S. Warren
(74) *Attorney, Agent, or Firm*—Harness, Dickey & Pierce, PLC

(57) ABSTRACT

An automatic player piano is broken down into an acoustic piano and an automatic playing system, and solenoid-operated key actuators are driven to rotate the black/white keys of the acoustic piano; the space between the keyboard and the array of black/white keys is so narrow that the manufacturer provides the solenoid-operated key actuators in the space below the key bed; plunger holes are formed in the rear portion of the key bed, and the solenoids occupy the space under the key bed so that the plungers project through the plunger holes into the space beneath the rear portions of the keys; the key bed is does not lose the mechanical strength so that the tuning work is not frequently required for the key action units.

5 Claims, 18 Drawing Sheets

KEYBOARD MUSICAL INSTRUMENT EQUIPPED WITH AUTOMATIC PLAYER AND METHOD FOR RETROFITTING KEYBOARD MUSICAL INSTRUMENT

FIELD OF THE INVENTION

This invention relates to a keyboard musical instrument and, more particularly, to a keyboard musical instrument equipped with an automatic player for performing a piece of music without any fingering of a human player and a method for retrofitting a keyboard musical instrument to the keyboard musical instrument equipped with the automatic player.

DESCRIPTION OF THE RELATED ART

The keyboard musical instrument with the automatic player is called as "automatic player piano", and FIG. 1 shows a typical example of the automatic player piano. The prior art automatic player piano largely comprises an acoustic piano 10A and an automatic playing system 10B. A pianist plays a tune on the acoustic piano 10A, and the automatic playing system 10B also performs a tune on the acoustic piano 10A as if the pianist plays the tune.

The acoustic piano 10A is a grand piano, and comprises a piano case 11, a keyboard KYB, action units HA, dampers 12, hammers HM and strings 13. These component parts 11/KYB/HA/12/HM/13 are well known to persons skilled in the art. For this reason, the component parts 11/KYB/HA/12/HM/13 are hereinafter described to the extent of making the skilled persons understand technical problems to be solved by the present invention. In the following description, term "front" modifies a position closer to a pianist, who sits on a stool for fingering, than a position modified with "rear". A line drawn between a front position and the corresponding rear position is directed to the "fore-and-aft" direction, and the lateral direction crosses the fore-and-aft direction at right angle.

A key bed KB forms a part of the piano case 11. The key bed KB is supported by legs 11*a*, and is maintained in parallel to the floor (not shown). The key board KYB is mounted on the key bed KB. The keyboard KYB includes a key frame KF, black and white keys KY, front pins FP and balance pins BP. The black keys and white keys KY extend in the fore-and-aft direction, and are laid on the well-known pattern in the lateral direction. The balance pins BP project the key frame KF, and keep the associated black/white keys KY rotatable over the key frame KY. The front pins FP also project from the key frame KF, and guide the associated black/white keys KY in the rotation.

As will be better seen in FIG. 2, a front rail KF1, a balance rail KF2, a rear rail KF3 and tie plates TP form in combination the key frame KF. The front rail KF1, balance rail KF2 and rear rail KF3 extend in the lateral direction, and are arranged in parallel. The tie plates TP are arranged in the fore-and-aft direction, and are connected to the front rail KF1, balance rail KF2 and rear rail KF3. The balance pins BP project from the balance rail KF2, and pass through holes formed in the associated black/white keys KY. The front pins FP project from the front rail KF1, and are inserted into the recesses from in the front portions of the black/white keys KY. For this reason, when a pianist selectively depresses the black/white keys KY, the black/white keys KY independently start the rotation about the balance rail KF2 as indicated by an arrow AR1, and the front pins FP guide the depressed black/white keys KY onto the front rail KF1.

Turning back to FIG. 1, the black and white keys KY are respectively associated with the action units HA and damper 12, and the action units HA are linked with the hammers HM, respectively. The strings 13 are stretched over the hammers HM. The action units HA are arranged in the lateral direction, and are maintained over the rear portions of the associated black and white keys KY. On the other hand, the dampers 12 are provided over the rearmost ends of the associated black and white keys KY, and are moved by the depressed black and white keys KY in the up-and-down direction. The action units HA are actuated by the depressed black and white key KY, and drive the associated hammers HM for rotation through the escape. The dampers 12 are also actuated by the depressed black and white keys KY. While the black and white keys KY are resting at their rest position, the dampers 12 are held in contact with the associated strings 13, and prevent the associated strings 13 from unintentional vibrations.

The pianist assumes to depress the front position of the white key KY shown in FIG. 1. The white key KY starts to sink toward the front rail KF1, i.e., the rotation about the balance rail KF2. The white key KY firstly lifts the associated damper 12, and the damper 12 is spaced from the string 13. Subsequently, the white key KY makes the action unit HA escape from the hammer HM, and the hammer HM starts the free rotation toward the string 13. The pianist feels the key touch unique at the escape. The hammer HM strikes the string 13 at the end of the free rotation, and vibrates for generating a tone. The hammer HM rebounds on the string 13, and the action unit HA receives the hammer HM. The pianist releases the depressed white key KY. Then, the self-weight of the action unit HA and hammer HM is exerted on the rear portion of the white key KY, and causes the white key KY to return to the rest position. The damper 12 is downwardly moved, and is brought into contact with the vibrating string 13. The damper 12 suppresses the vibrations. The action unit HA returns to the rest position together with the hammer HM.

The automatic playing system 10B includes an array HMM of solenoid-operated key actuators AC, a holder SU and a controller (not shown). The holder SU is secured to the key bed KB, and keeps the array HMM under the rear portions of the black and white keys AC. In detail, the key bed KB is formed with a slot PR, which is located at the back of the rear rail KF3. The slot PR laterally extends under the rear portions of the black and white keys KY. The holder SU is bolted to the reverse surface of the key bed KB, and the array HMM is bolted to the holder SU. The solenoid-operated key actuators AC are arranged in the staggered fashion, and a yoke 14 retains solenoids 15 and plungers PJ in the slot PR. The plungers PJ are projectable from and retractable into the associated solenoids 15, and are capable of pushing the rear end portions of the associated white and black keys KY. Since the array of solenoid-operated key actuators AC is slightly wider than the slot PR, the holder SU maintains the array of solenoid-operated key actuators AC in the slot PR, and the yoke 14 and plungers PJ are exposed to the narrow space between the key bed KB and the array of black and white keys KY. The solenoids 15 are connected to a driving circuit of the controller, and are selectively energized.

When the pianist instructs the controller to perform a piece of music, the controller starts to selectively energize the solenoids 15. The energized solenoids 15 cause the associated plungers PJ to project therefrom, and the plungers PJ push the rear end portions of the associated black and white keys KY. Thus, the solenoid-operated key actuators AC give rise to the rotation about the balance rail KF2 without any fingering of the human pianist. The black and white keys KY actuate the associated dampers 12 and action units HA, and the tones are generated from the vibrating strings 13.

A problem is encountered in the prior art automatic player piano in that the user finds the key touch changed within a relatively short time period. The user needs a tuner for tuning the action units HA. The user requests the manufacturer to dispatch the tuner, and the tuner tunes the action units HA at the user's home.

SUMMARY OF THE INVENTION

It is therefore an important object of the present invention to provide a keyboard musical instrument equipped with an automatic player which is free from the change of the key touch.

It is also an important object of the present invention to provide a method for retrofitting a keyboard musical instrument to the keyboard musical instrument equipped with the automatic player piano.

The present inventors investigated the cause of the unstable key touch, and found the key bed KB warped. The present inventors further investigated the matter minutely. The present inventors compared the key bed KB with the key bed of the standard grand piano to see whether or not the key bed was as serious in warp as the key bed KB. The present inventors found the warp of the key bed KB more serious than that of the key bed of the standard grand piano. The present inventors finally reached the conclusion that the key bed KB had been reduced in flexural rigidity due to the slot PR.

To accomplish the object, the present inventors propose to make plungers of actuators reaching a space under a tone generating mechanism through holes formed in a bottom board.

In accordance with one aspect of the present invention, there is provided a keyboard musical instrument comprising an acoustic keyboard musical instrument including a case having a bottom board for defining a bottom of the case, the bottom board being formed with plural holes and a tone generating mechanism housed in the case and selectively generating tones, and an automatic playing system actuating the tone generating mechanism for generating the tone without any fingering of a human player and including plural actuators having respective plungers passing through the plural holes and reciprocally moved for actuating the tone generating mechanism and respective converters for converting a certain sort of energy to a force exerted on the plural plungers and a controller connected to the converters so as to selectively drive the plungers to actuate the tone generating mechanism.

In accordance with another aspect of the present invention, there is provided a method for retrofitting an acoustic keyboard musical instrument to an automatic player keyboard comprising the steps of preparing a handy tool and an automatic playing system including a controller and plural actuators having respective plungers and respective converters to be connected to the controller for converting a certain sort of energy to a force to be exerted on the plungers, determining portions of a bottom board forming a part of the acoustic keyboard musical instrument, forming holes at the portions by using the handy drill, and providing the converters in a space below the bottom board in such a manner that the plungers reach a space under a tone generating mechanism of the acoustic keyboard musical instrument through the holes.

BRIEF DESCRIPTION OF THE DRAWINGS

The features and advantages of the keyboard musical instrument equipped with the automatic player and the method for retrofitting will be more clearly understood from the following description taken in conjunction with the accompanying drawings, in which.

DESCRIPTION OF THE PREFERRED EMBODIMENTS

First Embodiment

Structure of Automatic Player Piano

Figure 1:
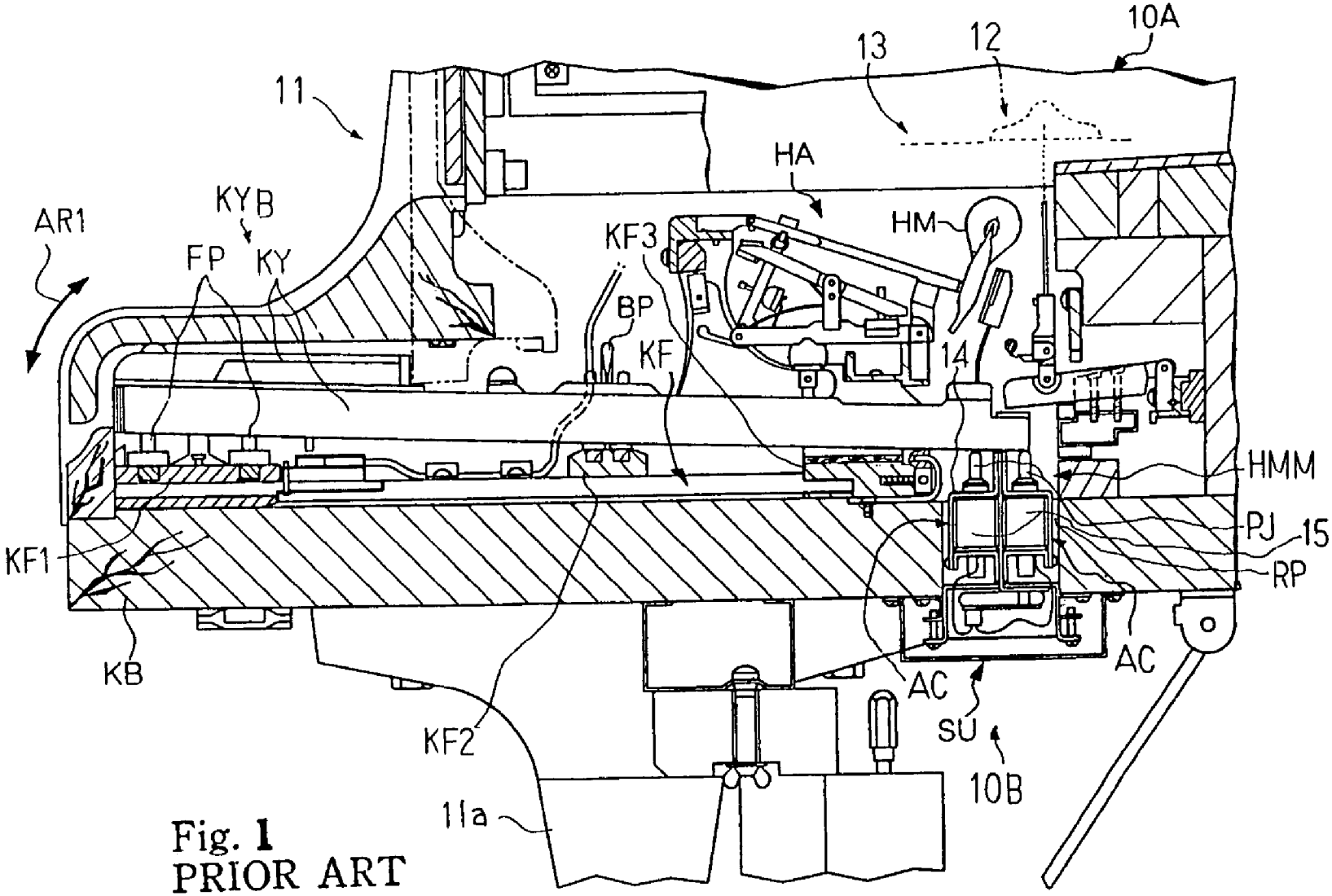
Fig. 1 PRIOR ART
FIG. 1 is a cross sectional side view showing the structure of the prior art automatic player piano.
Figure 2:
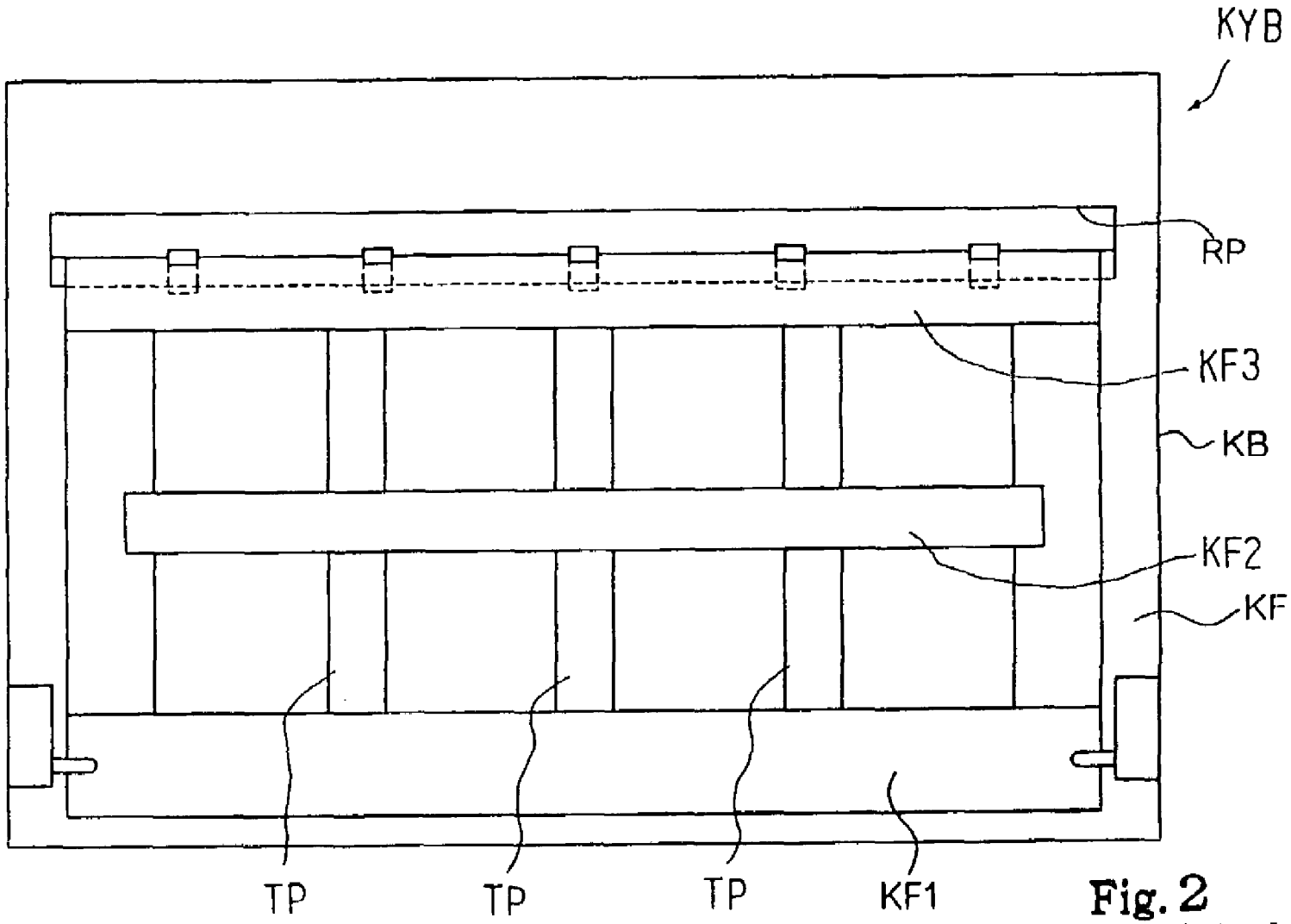
Fig. 2 PRIOR ART
FIG. 2 is a plane view showing the layout of the key bed incorporated in the prior art automatic player piano.
Figure 3:
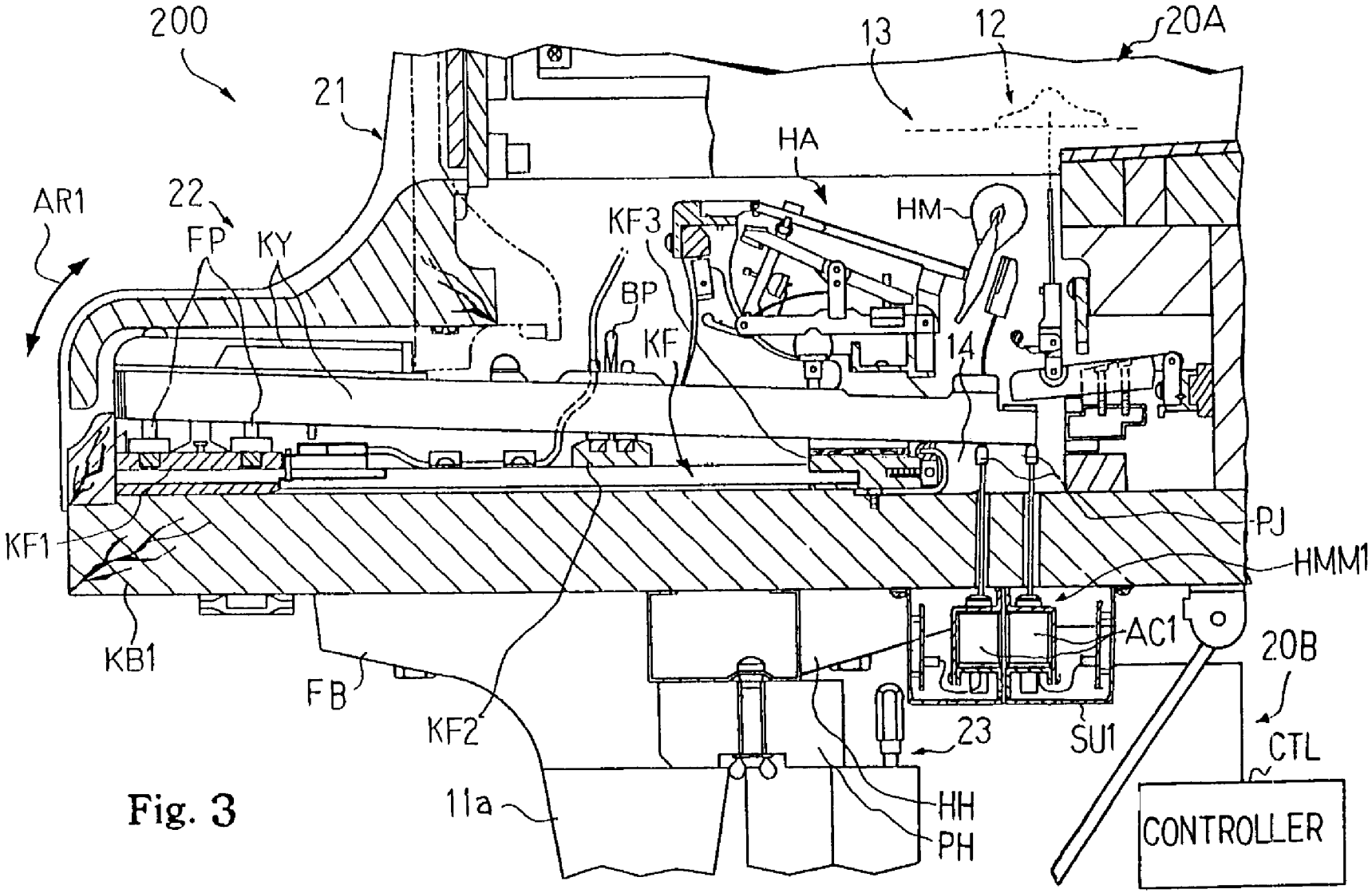
FIG. 3 is a cross sectional side view showing the structure of an automatic player piano according to the present invention.

Referring to FIG. 3, an automatic player piano embodying the present invention largely comprises an acoustic piano 20A and an automatic playing system 20B. In this instance, a grand piano serves as the acoustic piano 20A, and a user can perform a piece of music through his or her fingering on the acoustic piano or by means of the automatic playing system 20B.

The acoustic piano 20A comprises a piano case 21, a keyboard 22, action units HA, hammers HM, dampers 12, strings 13 and a pedal system 23. The piano case 21 includes a key bed KB1, which is different from the key bed KB. However, the keyboard 22 is similar in structure to the keyboard KYB. For this reason, the component parts of the keyboard 22 are labeled with the references designating the corresponding component parts of the keyboard KYB without detailed description. The action units HA, hammers HM, dampers 12 and strings 13 are similar to those of the prior art acoustic piano 10A, and no further description is hereinafter incorporated for the sake of simplicity.

Figure 4A:
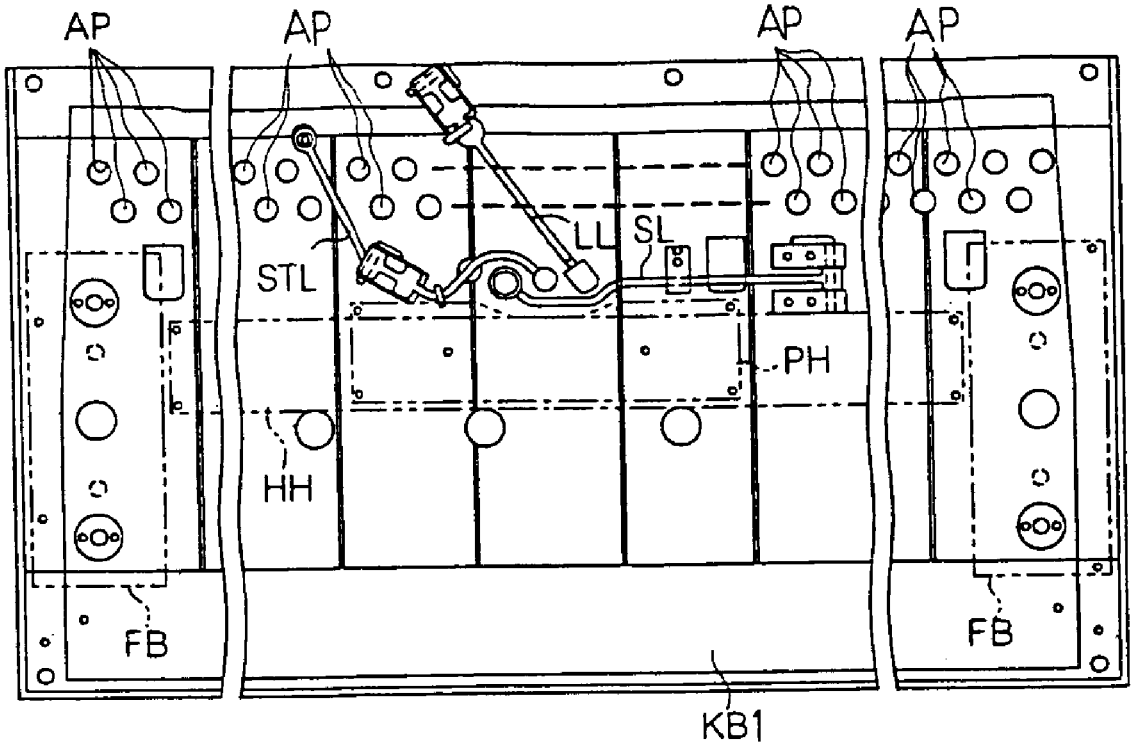
FIG. 4A is a bottom view showing plunger holes formed in a key bed incorporated in the automatic player piano.
Figure 4B:
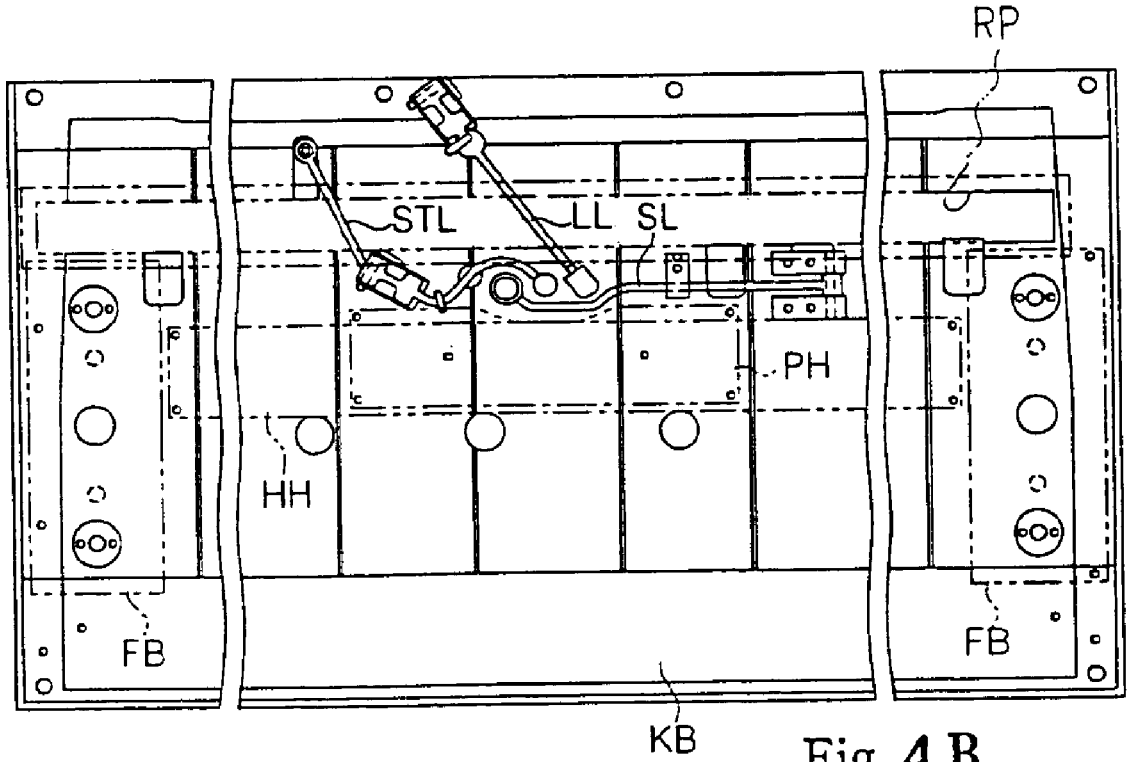
Fig. 4 B PRIOR ART
FIG. 4B is a bottom view showing the slot formed in the key bed of the prior art automatic player piano.

The legs 11*a* are connected to leg blocks FB, and the leg blocks FB are bolted to the key bed KB1. The legs 11*a* keep the key bed KB1 parallel to the floor. The key bed KB1 is formed with plunger's holes AP, and the plunger's holes AP are arranged in a staggered fashion (see FIG. 4A) in the lateral direction. Comparing FIG. 4A with FIG. 4B, it is understood that the plunger's holes AP are arranged in the area equivalent to the slot RP. However, the total area of the plunger's holes AP is much less than the area of the slot RP. The plunger's holes AP will be described in detail in conjunction with solenoid-operated key actuators.

A bottom beam HH is secured to the reverse surface of the key bed KB1, and a lyre block PH is further secured to the lower surface of the bottom beam HH. Pedals are supported by the lyre block PH, and are linked with the key frame KF and dampers 12. In detail, a pedal system 23 includes a soft pedal, a damper pedal and a sostenuto pedal. The soft pedal is connected through a soft pedal link work SL to the key frame KF, and the damper pedal and sostenuto pedal are connected to the dampers 12 through a damper pedal link work LL and a sostenuto pedal link work STL. The pianist selectively steps on the soft pedal, damper pedal and sostenuto pedal in his or her performance. Then, the acoustic piano tones are decreased in loudness or prolonged.

The automatic playing system 20B comprises an array HMM1 of solenoid-operated key actuators AC1, plural actuator holders SU1 and a controller CTL. A microprocessor is incorporated in the controller CTL, and achieves given tasks through execution of computer programs. The plural actuator holders SU1 are arranged in the lateral direction, and are secured to the lower surface of the key bed KB1. The plural actuator holders SU1 and lower surface of the key bed KB1 define an inner space, and the solenoid-operated key actuators AC1 are accommodated in the inner space. The solenoid-operated key actuators AC1 are arranged in the staggered fashion, and are respectively associated with the plunger holes AP. The solenoid-operated key actuators AC1 are push the black/white keys KY through the plunger holes AP, and give rise to the rotation about the balance rail KF2 without any fingering. In other words, the array HMM1 of solenoid-operated key actuators AC1 is provided under the key bed KB1, and selectively drives the black/white keys KY for rotation through the plunger holes AP. Thus, the automatic playing system 20B performs a music passage without sacrifice of the durability of the key bed KB1.

Figure 5:
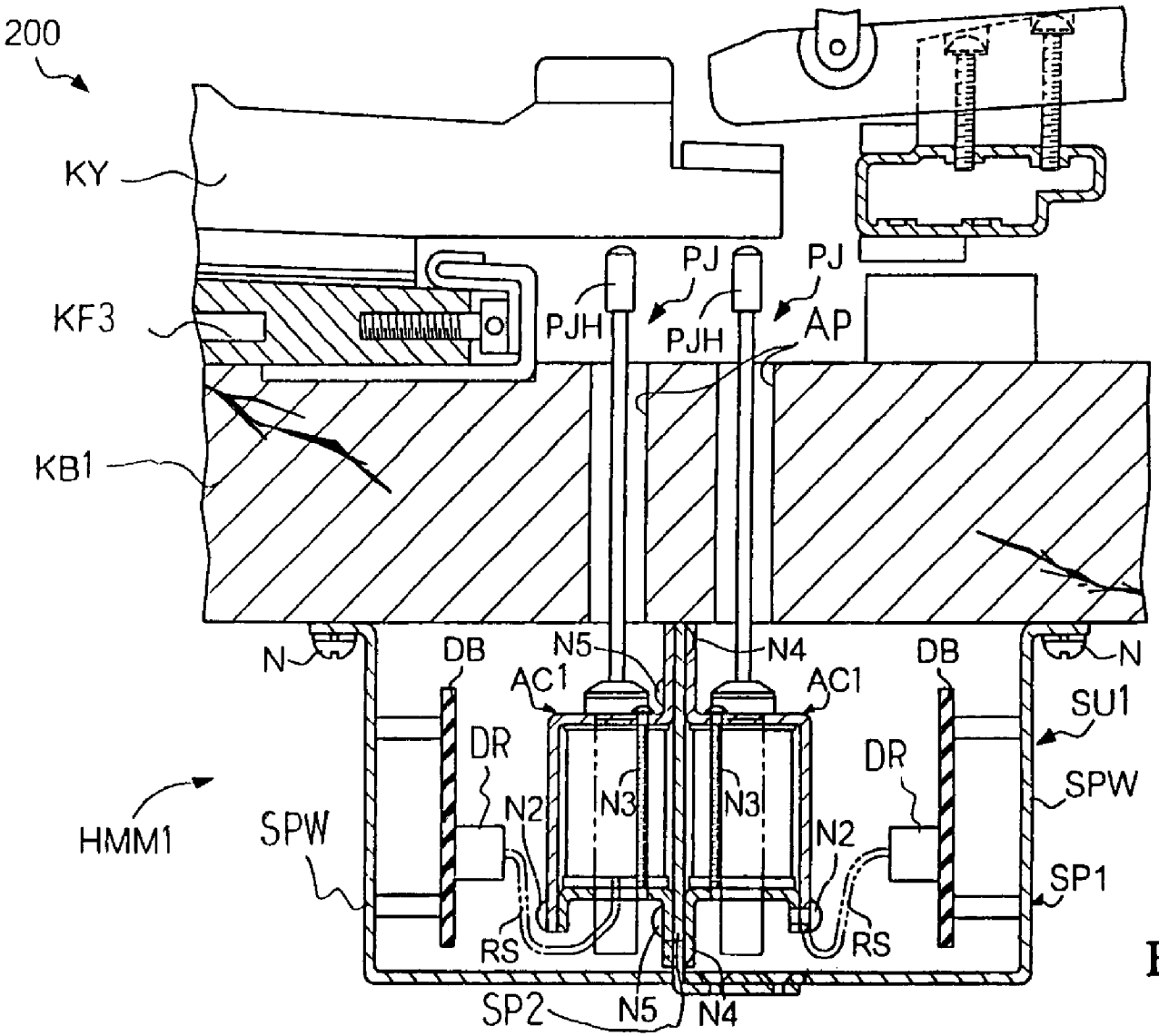
FIG. 5 is a cross sectional view showing the structure of an array of solenoid-operated key actuators incorporated in the automatic player piano.

Turning to FIG. 5 of the drawings, each of the actuator holder SU1 includes a channel bar SP1 and a center plate SP2. At least the center plate SP2 is made of soft magnetic material such as, for example, soft iron. The center plate SP2 is assembled with the channel bar SP1, and the solenoid-operated key actuators AC1 are secured to the center plate SP2. The center plate SP2 laterally extends between the two rows of plunger holes AP, and the channel bar SP1 is secured to the lower surface of the key bed KB1 by means of screws N.

Figure 6:
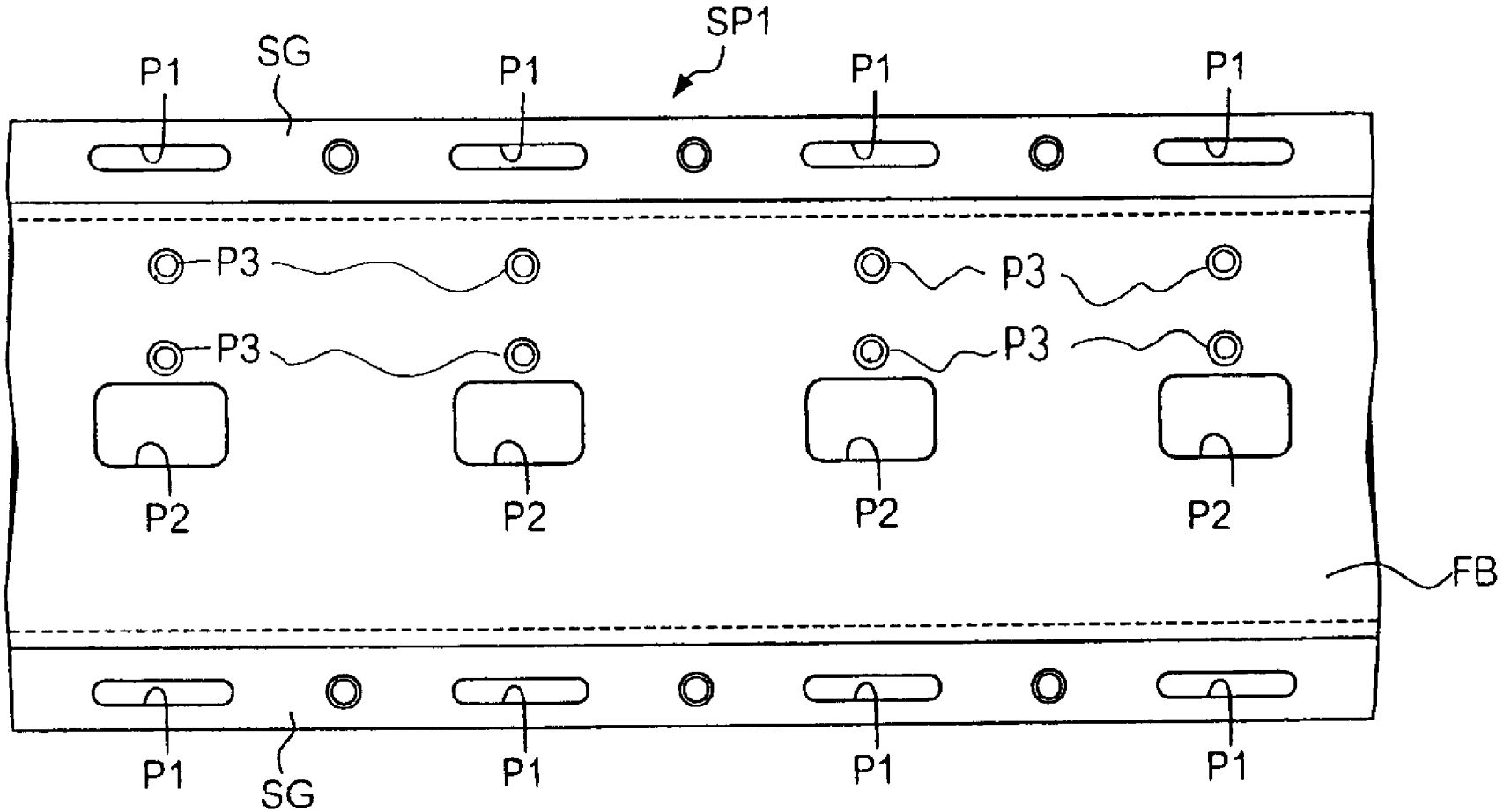
FIG. 6 is a plane view showing the layout of holes formed in a channel bar forming a part of an actuator holder.

The channel bar SP1 is illustrated in FIG. 6 in detail. The channel bar SP1 is long enough to support the plural solenoid-operated key actuators AC1, and is broken down into a flat bottom portion FB and a pair of flanges SG. The flanges SG project from both sides of the flat bottom portion FB. Elongated slots P1 are formed in the flange SG at intervals, and other elongated slots P1 are also formed in the other flange SG at the intervals. The elongated slots P1 has the width substantially equal to the diameter of the threaded stems of the screws N, and the screws N press the channel bar SP1 to the lower surface of the key bed KB1. Rectangular holes P2 and pairs of through-holes P3 are formed in the bottom portion FB. The rectangular holes P2 are arranged in the longitudinal direction of the channel bar SP1 at intervals, and the pairs of through-holes P3 are formed between the rectangular holes P2 and one of the flanges SG. The center plate SP2 is assembled with the channel bar SP1 through the rectangular holes P3.

Figure 7A:
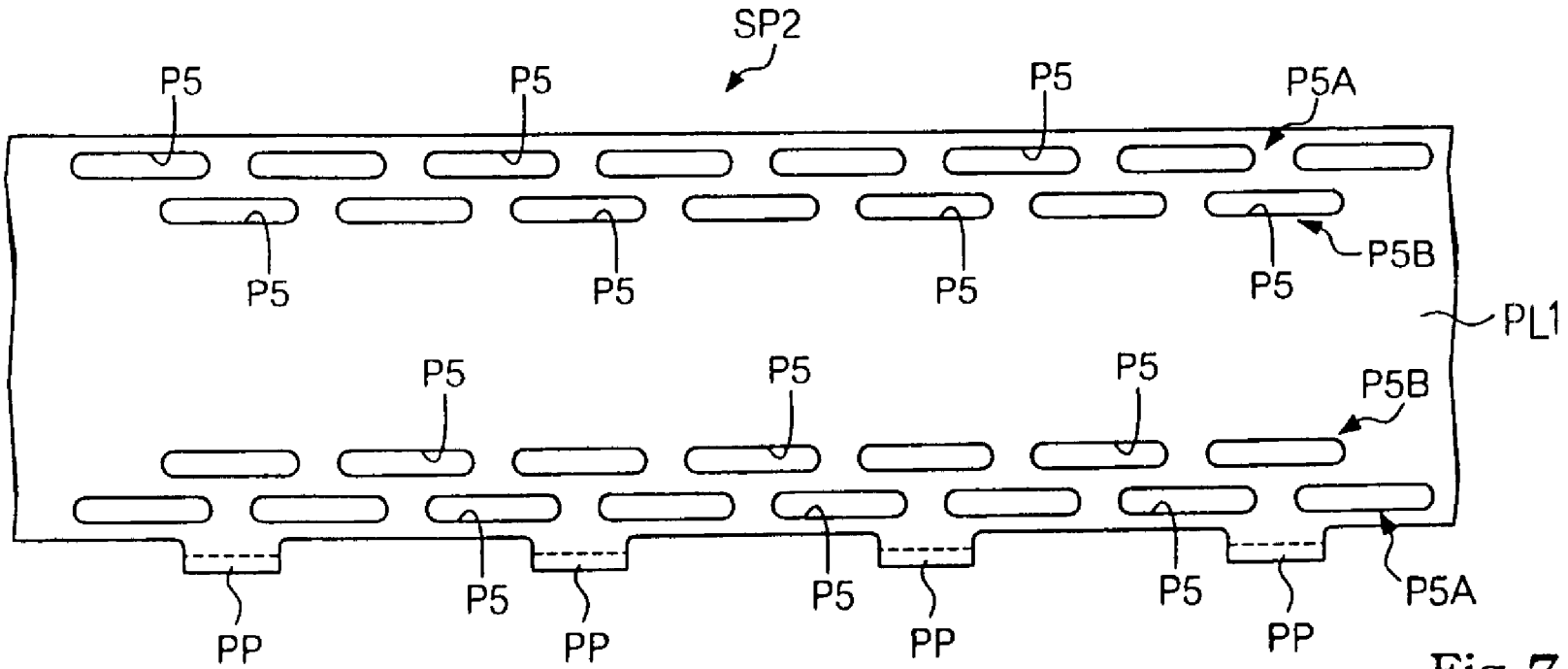
FIG. 7A is a front view showing the layout of holes formed in a center wall forming another part of the actuator holder.
Figure 7B:
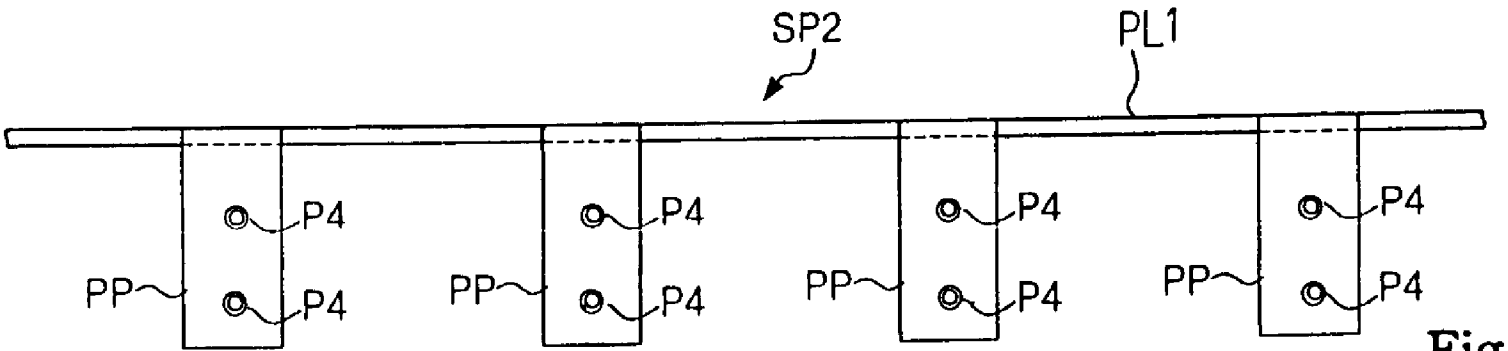
FIG. 7B is a bottom view showing the layout of holes formed in the center wall.

The center plate SP2 is illustrated in FIGS. 7A and 7B in detail. The center plate SP2 has a wall portion PL1 and tongues PP. The center plate SP2 is rectangular, and four rows of elongated slots P5 are formed therein. Two rows of elongated slots P5 are spaced from the remaining row rows of elongated slots P5 in the up-and-down direction. The elongated slots P5 of the upper two rows are arranged in a staggered manner, and the elongated slots P5 of the lower two rows are also arranged in the staggered manner. The elongated slots P5 of each row are spaced at regular pitches equal to the elongated slots P5 of the other rows. The uppermost row of elongated slots P5 is paired with the lowermost row of elongated slots P5, and the pair of rows is labeled with P5A. The middle rows of elongated slots P5 are paired with each other, and the pair of middle rows is labeled with P5B. The elongated slots P5 of the row pair P5A are selectively assigned to the solenoid-operated key actuators AC1, and the elongated slots P5 of the row pair P5B are also assigned to the remaining solenoid-operated key actuators AC1. The solenoid-operated key actuators AC1 assigned the row pair P5A are alternated with the solenoid-operated key actuators AC1 assigned the row pair P5B. The solenoid-operated key actuators AC1 are bolted to the wall portion PL1 through the elongated slots P5 as will be hereinafter described in detail.

The tongues PP form an angle of 90 degrees with the wall portion PL1, and project from the lower edge of the wall portion PL1 at the intervals equal to the intervals of the rectangular holes P2. The width of the tongues PP is approximately equal to the width of the rectangular holes P2. The tongues PP are respectively associated with the rectangular holes P2, and are to be inserted thereinto in the assembling work. The tongues PP are formed with pairs of threaded-holes P4, and the threaded-holes P4 of each pair are spaced from each other by a distance equal to the distance between the through-holes P3 of the associated pair.

The center plate SP2 is assembled with the channel bar SP1 as follows. An assembling worker aligns the tongues PP with the rectangular holes P2, respectively, and inserts the tongues PP into the rectangular holes P2 from the space between the flanges SG. The assembling worker raises the center plate SP2, and makes the tongues PP brought into contact with the lower surface of the bottom portion FB. Then, the pairs of threaded-holes P4 are respectively aligned with the pairs of through-holes P3. The assembling worker drives bolts (not shown) through the through-holes P3 into the threaded holes P4 so as to secure the tongues PP to the bottom portion FB.

Figure 8A:
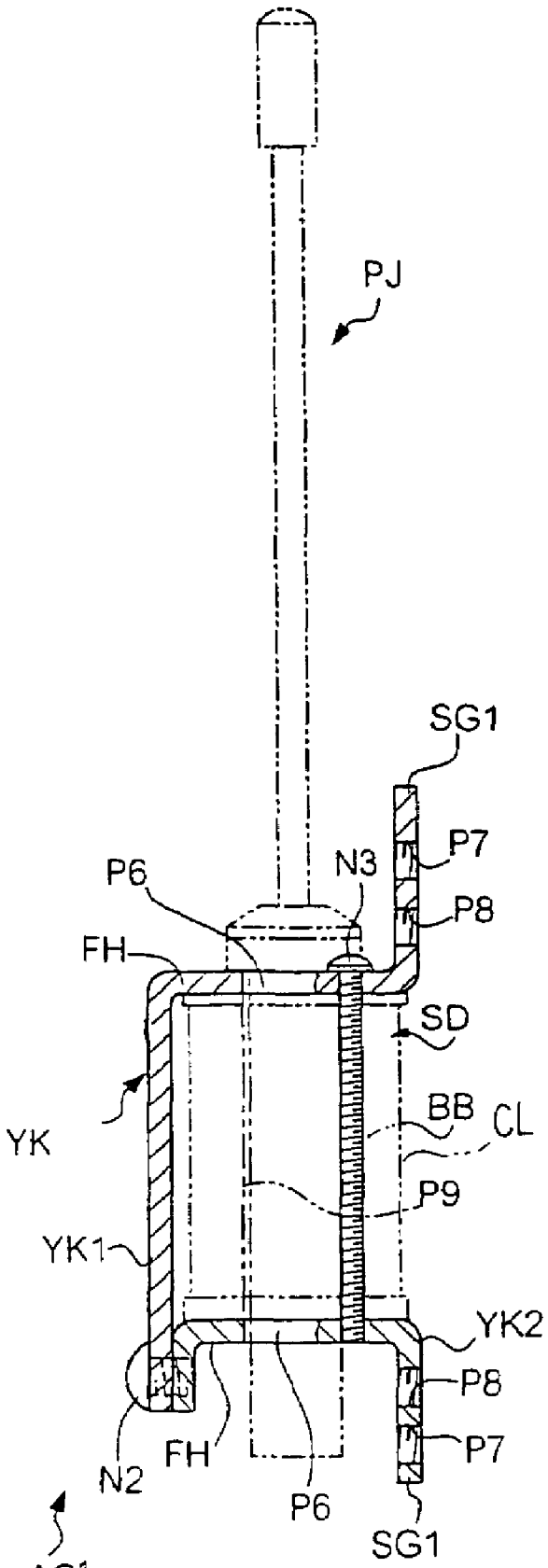
FIG. 8A is a side view showing the structure of a solenoid-operated key actuator.
Figure 8B:
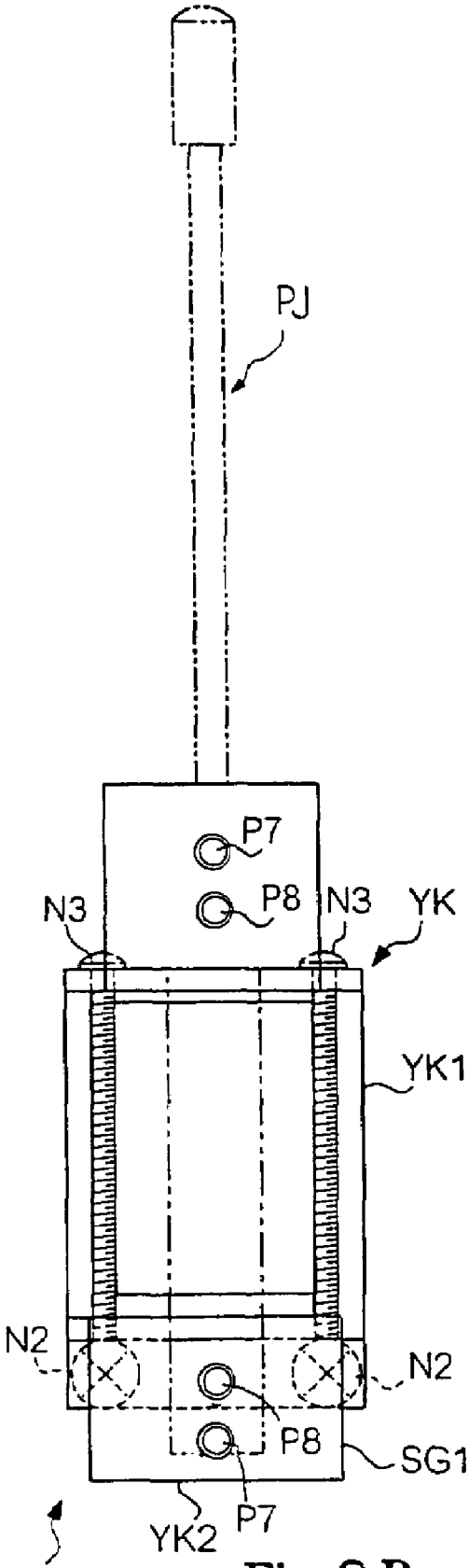
FIG. 8B is a rear view showing the structure of the solenoid-operated key actuator.

Turning to FIGS. 8A and 8B, each of the solenoid-operated key actuators includes a yoke YK, a solenoid SD and a plunger PJ. The solenoid SD is supported by the yoke YK, and the yoke YK is made of magnetic substance. The yoke YK and center plate SP2 offer a magnetic circuit to the plunger PJ. The plunger PJ is partially housed in the solenoid SD, and is projectable from and retractable into the solenoid SD. The yoke YK is secured to the center plate SP2, and the plunger PJ projects over the actuator holder SU1. The plunger PJ passes through the plunger hole AP, and reaches the space beneath the lower surface of the rear portion of the associated black/white key KY. In this instance, the plunger hole AP is wider in cross section than the plunger PJ, and is smaller in cross section than the yoke YK. Thus, although the plunger hole AP can not receive the yoke YK, the plunger hole AP permits the plunger PJ to project over the key bed KB1.

The minimum diameter of the plunger holes AP is depending upon the diameter of the plungers PJ moved therein. It is preferable to form the plunger holes AP as small as possible in so far as the plungers PJ are moved without friction between the moving portions and the inner surfaces defining the plunger holes AP.

The yoke YK is broken down into two plates YK1 and YK2. The plate YK1 is cranked, and both side portions of the other plate YK2 are turned down. The plates YK1 and YK2 are assembled into the yoke YK, and form a channel portion FH defining a space where the solenoid SD is received. The channel portion FH is further formed with through-holes P6, and the through-holes P6 are aligned with each other. The yoke YK has flanges SG1 on both ends of the channel portion FH, and the flanges SG1 are formed with two pairs of threaded holes P7/P8. The flanges SG1 are held in contact with the center plate SP2, and the gap between the threaded hole P7 and the threaded hole P8 is equal to the gap between the elongated slot P5 of the outer row and the elongated slot P5 of the inner row P5B. For this reason, the threaded holes P7/P8 are alignable with the elongated slots P5 of the four rows. Nevertheless, only one pair of threaded-holes P7/P8 is used for securing the yoke YK to the center plate SP2.

The solenoid SD includes a bobbin BB and a conductive wire. The bobbin BB is cylindrical, and the conductive wire is wound on the bobbin BB so as to serve as a coil CL. The plunger PJ is inserted into the inner space of the bobbin BB. The bobbin BB is approximately equal in height to the space defined by the channel portion FH, and the diameter of the coil CL on the bobbin BB is approximately equal to the width and depth of the space. The solenoid SD is snugly received in the space of the channel portion FH, and is secured to the yoke YK by means of a bolt N3. In other words, the solenoids SD are clamped between the two plates YK1 and YK2.

Turning back to FIG. 5, the actuator holder SU1 further includes rigid circuit boards DB, and the rigid circuit boards DB are bolted to the side walls SPW of the channel bar SP1. Driver circuits DR are mounted on the rigid circuit boards DB, and the driver circuits DB are connected to the coils CL through lead wires RS. The controller CTL is connected to the driver circuits DR through lead wires (see FIG. 3), and instructs the driver circuits DB selectively to energize the coils CL of the solenoid-operated key actuators AC1.

Figure 9:
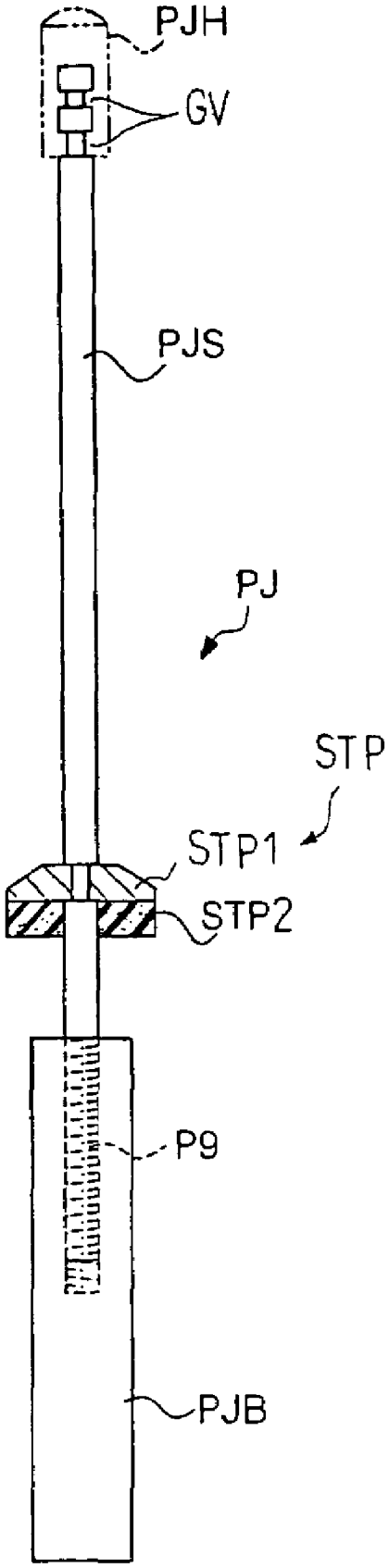
FIG. 9 is a partially cut-away front view showing a plunger incorporated in the solenoid-operated key actuator.

FIG. 9 shows the plunger PJ. The plunger PJ has a boss portion PJB and a shaft portion PJS. The boss portion PJB is made of magnetic substance such as, for example, soft iron. The boss portion PJB is cylindrical, and is approximately equal in diameter to the inner space of the bobbin BB. The shaft portion PJS is smaller in diameter than the boss portion PJB and plunger hole AP, and is long enough to pass through the plunger hole AP. A female screw is formed in the boss portion PJB, and has a centerline coincident with the centerline of the boss portion PJB. On the other hand, a male screw P9 is formed on the shaft portion, and is driven into the female screw. The centerline of the boss portion PJB is aligned with the centerline of the shaft portion PJS.

The plunger PJ further includes a stopper STP and a head PJH. The head PJH is made of resilient material such as, for example, rubber, and prohibits the plunger PJ from generating noise at the contact with the lower surface of the associated black/white key KY. A ring STP1 and a cushion sheet STP2 form the stopper STP. The ring STP1 is made of metal, and is secured to the shat portion at a certain position lower than the intermediate point of the shaft portion PJS. The cushion sheet STP2 is, by way of example, made of sponge, and is adhered to the lower surface of the ring STP1. The cushion sheet STP2 is brought into contact with the yoke YK when the plunger PJ reaches the lower dead point, and absorbs the impact. The shaft portion PJS is formed with annular grooves GV, and the head PJH is attached to the tip of the shaft portion PJS. The annular grooves GV prevent the head PJH from separation from the shaft portion PJS. In this instance, the head PJH is smaller in diameter than the plunger hole AP. For this reason, the heads PJH can pass through the plunger holes AP.

Figure 10:
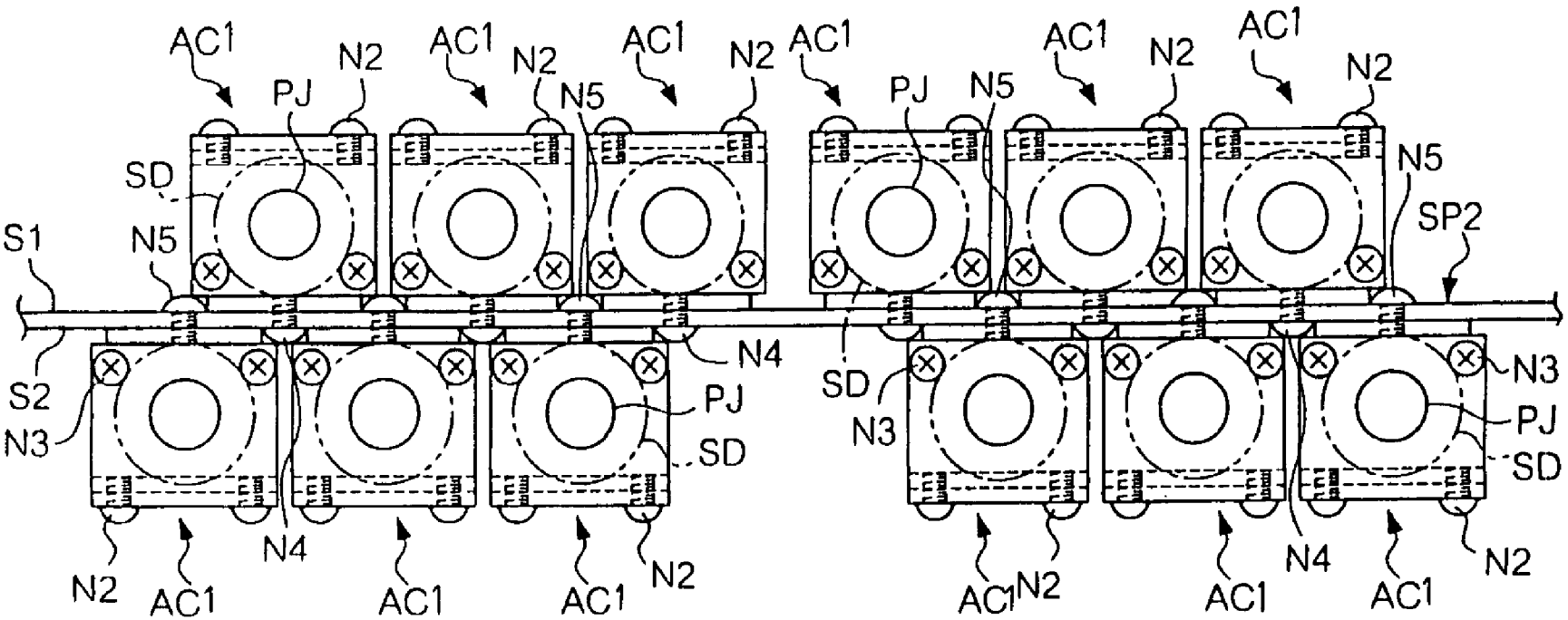
FIG. 10 is a plane view showing the layout of the solenoid-operated key actuators.

The solenoid-operated key actuators AC1 are arranged in a staggered manner on a front surface S1 and a rear surface S2 of the center plate SP2 as shown in FIG. 10. The elongated slots P5A are used for the solenoid-operated key actuators AC1 on the front surface S1, and the elongated slots P5B are used for the solenoid-operated key actuators AC1 on the rear surface S2.

In detail, the solenoid-operated key actuators AC1 are placed on the front surface S1, and the threaded holes P7 are aligned with the elongated slots P5 of the outer rows P5A. Screws N4 are driven into the threaded holes P7 through the elongated slots P5. The other solenoid-operated key actuators AC1 are placed on the rear surface S2, and the threaded holes P8 are aligned with the elongated slots P5 of the inner rows P5B. Screws N5 are driven into the threaded holes P8 through the elongated slots P5. Thus, the solenoid-operated key actuators AC1 are arranged in the staggered manner on the front and rear surfaces S1/S2 of the center plate SP2.

The array HMM1 of solenoid-operated key actuators AC1 is installed in the automatic player piano as follows. First, the channel bars SP1 and center plates SP2 are assembled into the plural actuator holders SU1. The solenoid-operated key actuators AC1 are secured to the center plates SP2. Thus, the plural actuator holders SU1 are completed.

Subsequently, one of the actuator holders SU1 is moved under the key bed KB1, and the actuator holder SU1 is lifted toward the key bed KB1. The plunger heads PJH are respectively aligned with the plunger holes AP, and the actuator holder SU1 are further lifted so that the pair of flanges SG is brought into contact with the lower surface of the key bed KB1. The plunger heads PJH pass through the plunger holes AP, and reach the space beneath the lower surfaces of the rear portions of the black/white keys KY. The screws N are driven into the key bed KB1 through the elongated slots P1. If the plunger heads PJH are offset from the center of the lower surfaces of the associated black/white keys KY, the screws N are loosened, and the actuator holder SU1 is adjusted to the optimum position. The elongated slots P1 permit the worker to move the actuator holder SU1 laterally. Otherwise, the screws N4/N5 are loosened, and the solenoid-operated key actuators AC1 are adjusted to the optimum positions. The elongated slots P5 permit the worker to move the solenoid-operated key actuators AC1 laterally. The other actuator holders SU1 are similarly bolted to the lower surface of the key bed KB1.

Behavior of Automatic Player Piano

Assuming now that a user instructs the controller CTL to reproduce a performance represented by a set of music data codes, the music data codes are sequentially processed by the microprocessor of the controller CTL. When a music data code or codes reach the microprocessor, the microprocessor specifies a black/white key KY to be moved, and determines a target key velocity. The microprocessor further determines the magnitude of the driving signal for giving the target key velocity to the black/white key KY.

When the time at which the black/white key KY starts the motion, the microprocessor informs the driving circuit DR of the code assigned to the black/white key and the magnitude of the driving signal. Then, the driving circuit DR adjusts the driving signal to the target magnitude, and supplies the driving signal to the solenoid SD of the solenoid-operated key actuator AC1 through the lead wire RS. The solenoid SD creates the magnetic field, and the magnetic circuit extends through the yoke YK and center plate SP2. The magnetic force is exerted on the plunger PJ in the magnetic field, and the plunger PJ is moved upwardly.

The head PJH pushes the rear portion of the black/white key KY, and gives rise to the rotation about the balance pin BP. The black/white key KY actuates the action unit. The action unit makes the damper 12 spaced from the string 13, and the associated hammer HA is driven for rotation through the escape. The hammer HA strikes the string 13, and gives rise to the vibrations. Thus, the acoustic piano tone is generated without the fingering of any human player.

When another music data code representative of the release of the black/white key KY reaches the microprocessor, the microprocessor requests the driving circuit DR to remove the driving signal from the solenoid SD. The driving circuit DR removes the driving signal from the solenoid SD. Then, the plunger PJ is retracted into the bobbin BB, and the released black/white key KY returns to the rest position. The above-described sequence is repeated during the reproduction of the music passage.

Retrofitting Work

An acoustic piano is retrofitted to the automatic player piano as follows. The plunger holes AP are formed in the key bed KB1, and the automatic playing system 20B is installed in the acoustic piano in the retrofitting work.

Figure 11:
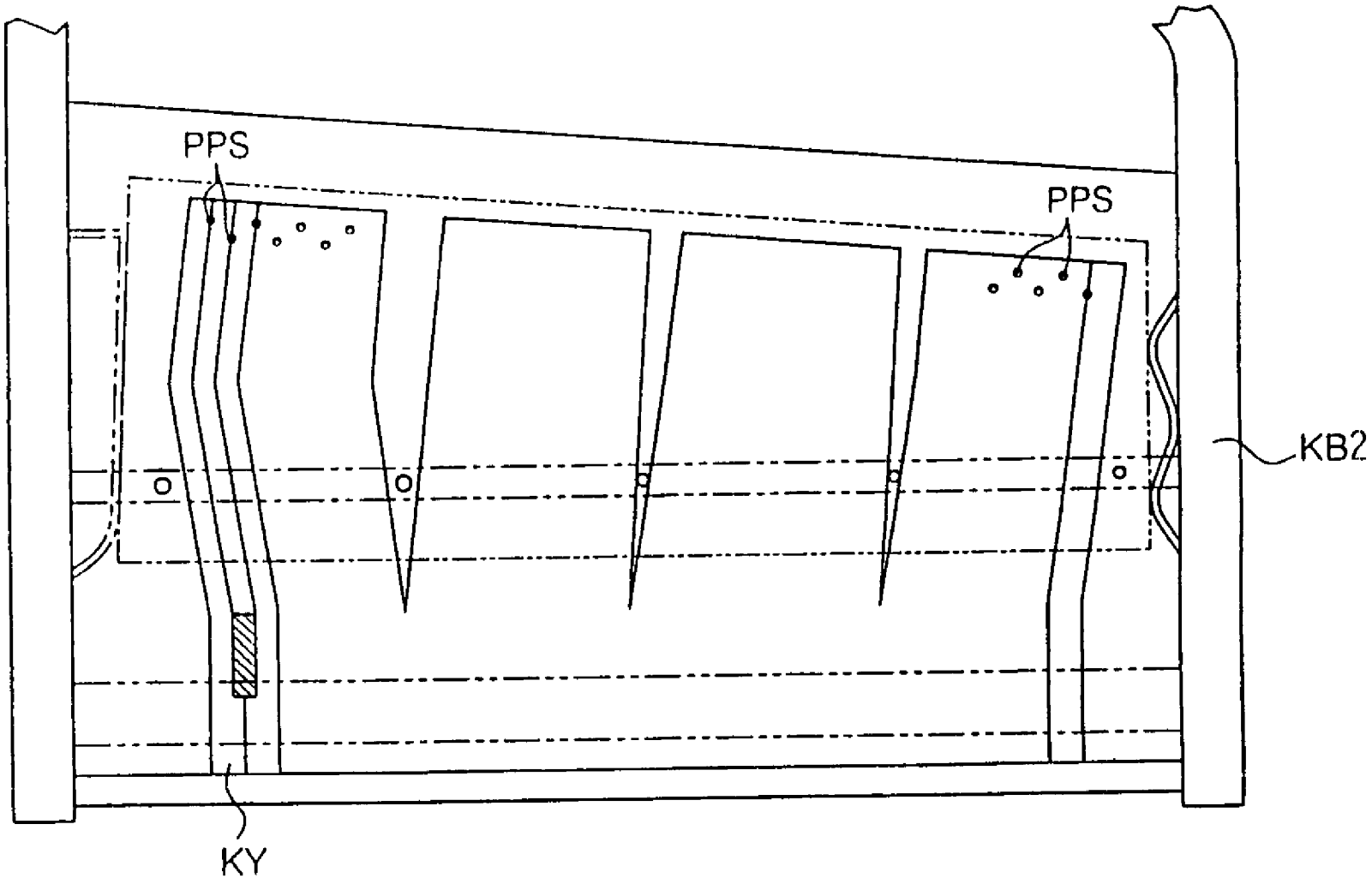
FIG. 11 is a plane view showing plunger holes to be formed in a key bed of an acoustic piano in a retrofitting work.

FIG. 11 shows the key bed KB2 of the acoustic piano to be retrofitted to the automatic player piano. A worker firstly puts marks PPS on the boundaries between the adjacent black/white keys KY on the board or a sheet of paper, which has been already inserted between the key bed KB2 and the black/white keys KY, through the gaps between the adjacent black/white keys KY. Dots PPS stand for the boundaries in FIG. 11. Alignment marks have been given to the sheet of paper.

Subsequently, the worker determines the centers of the plunger holes AP on the basis of the dots PPS, and forms the plunger holes AP in the key bed KB2. If two dots PPS are spaced from each other by 14 millimeters, the center of the plunger hole AP is spaced by 7 millimeters in the direction toward the front opening.

In case where the boundaries are plotted on the sheet of paper, the sheet of paper is taken out from between the key bed KB2 and the black/white keys KY, and the sheet of paper is adhered to the obverse surface or the reverse surface of the key bed KB2 by using the alignment marks. Thereafter, the plunger holes AP are formed in the key bed KB2 by using a suitable drill.

Subsequently, the solenoid-operated key actuators AC1 are assembled with the actuator holders SU1, and the driving circuits DR are connected to the solenoids SD through the lead wires RS. The actuator holders SU1 are secured to the key bed KB2 as similar to those described hereinbefore in detail.

Finally, the controller CTL is connected to the driving circuits DR. Then, the acoustic piano is retrofitted to the automatic player piano.

As will be understood from the foregoing description, the array HMM1 of solenoid-operated key actuators AC1 is provided under the key bed KB1/KB2, and the plungers PJ project over the key bed KB1/KB2 through the plunger holes AP. The wide slot RP is never required for the automatic playing system 20B, but the only small plunger holes AP are formed in the key bed KB1/KB2. The plunger holes AP little reduces the mechanical strength of the key bed KB1/KB2 such as the flexural rigidity. Thus, the key bed KB1/KB2 are much more durable than the prior art key bed KB, and the tuning work on the automatic player piano according to the present invention is not so frequent as that on the prior art automatic player piano.

The simple tools such as an electric drill or hand drills are required for the plunger holes AP. A worker easily carries the tools, and visits the user's home. The worker forms the plunger holes AP easier than the wide slot RP at the user's home. This means that most of the acoustic pianos are retrofitted to the automatic player pianos. Thus, the manufacturer can satisfy the user's demand.

Second Embodiment

Figure 12:
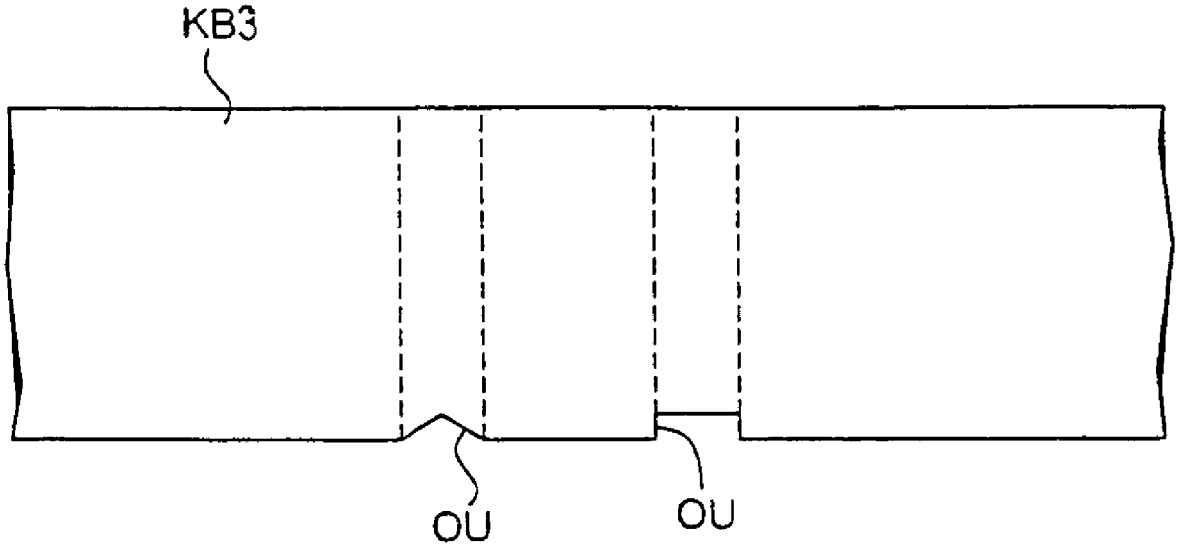
FIG. 12 is a side view showing marks put on a key bed of an acoustic piano.

FIG. 12 shows a key bed KB3 of an acoustic piano, which may be possibly retrofitted to the automatic player piano after delivery to a purchaser. The other component parts of the acoustic piano are similar to those of the acoustic piano 20A shown in FIG. 3. In the following description, the other components parts are designated by the references assigned to the corresponding component parts in FIG. 3.

While a worker is shaping a piece of wood into the key bed KB3, the worker forms caves or dents OU at the areas where the plunger holes AP will be formed. The caves or dents OU are either obverse or reverse surface of the key bed KB3. The worker may put marks indicative of the centers of the plunger holes AP instead of the caves or dents OU.

Otherwise, the worker drills shallow recesses. The caves, dents, marks and shallow recesses serve as "marks" indicative of the plunger holes AP.

When a worker visits user's home, the caves or dents OU are helpful. The worker immediately drills the plunger holes AP, and secures the actuator holders SU1 to the reverse surface of the key bed KB3. Thus, the marks OU reduce the load of the retrofitting work.

Third Embodiment

Figure 13:
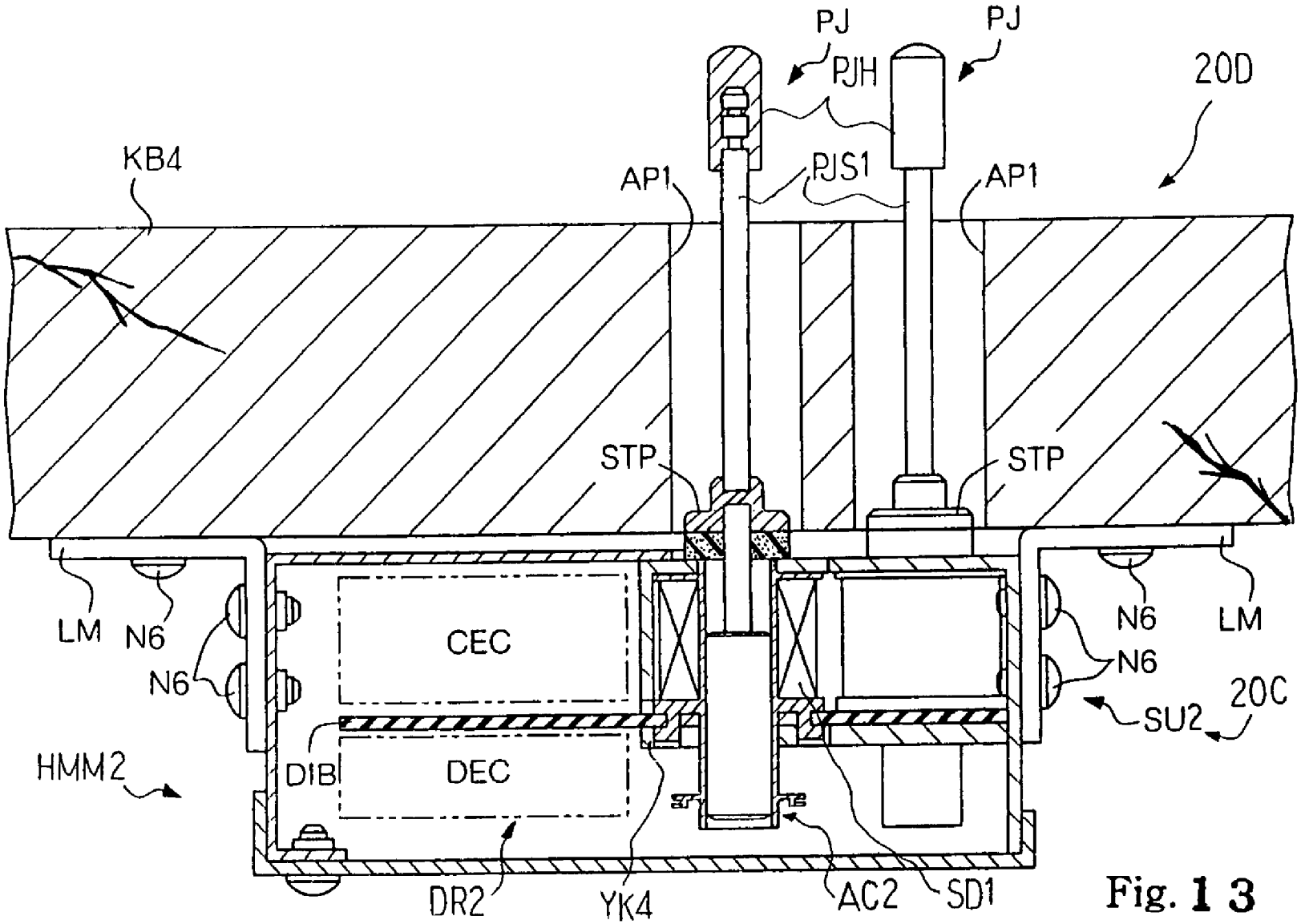
FIG. 13 is a cross sectional view showing the structure of an automatic playing system incorporated in another automatic player piano.

FIG. 13 shows an automatic playing system 20C incorporated in another automatic player piano or to be installed in an acoustic piano in the retrofitting work. The automatic player piano also largely comprises an acoustic piano 20D and the automatic playing system 20C. The acoustic piano 20D is similar to the acoustic piano 20A except for a key bed KB4. For this reason, description is focused on the key bed KB4 and automatic playing system 20C. Plunger holes AP1 are formed in the key bed KB4 in the staggered fashion, and are larger in diameter than the stoppers STP, which are larger in diameter than the plunger heads PJH. While the plungers PJ are staying at the rest positions, the stoppers STP are resting on the yokes YK4. When the solenoids SD1 are energized, the stoppers STP are moved in the plunger holes AP1 together with the shaft portions PJS1. This feature is desirable, because the manufacturer makes the actuator holders SU2 thinner than the actuator holders SU1.

The automatic playing system 20C includes the actuator holders SU2, an array HMM2 of solenoid-operated key actuators AC2 and a controller (not shown). The array HMM2 of solenoid-operated key actuators AC2 are housed in the actuator holders SU2, and a rigid board DIB is supported by the actuator holders SU2. The yokes YK4 are engaged with the rigid board DIB, and condensers CEC and solenoid drivers DEC, which form parts of driving circuits DR2, are mounted on the observe surface and reverse surface of the rigid board DIB, respectively. Angle bars LM are bolted to the front surface and rear surface of the actuator holders SU2, and are further secured to the reverse surface of the key bed KB4 by means of screws N6. The solenoids SD1 are connected to the driving circuits DR2, and the driving circuits DR2 are connected to the controller as similar to those of the first embodiment.

Figure 14:
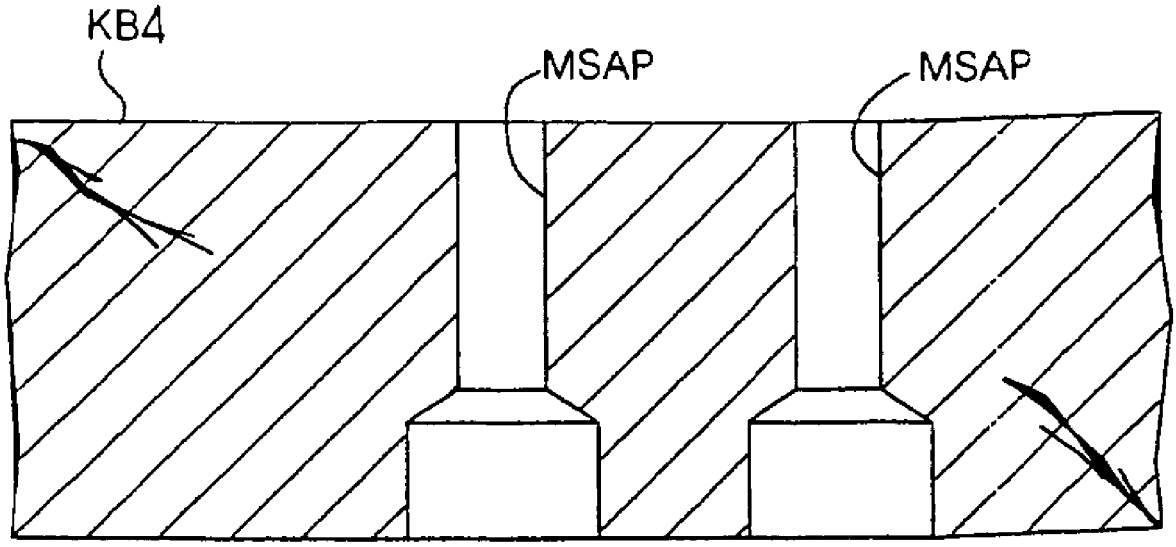
FIG. 14 is a cross sectional view showing another sort of plunger holes used in the key bed incorporated in the automatic player piano.

The plunger holes AP1 may be replaced with plunger holes MSAP as shown in FIG. 14. The plunger hole MSAP has a wide portion, in which the stopper STP is moved, and a narrow portion where the shaft portion PJS1 is moved. The plunger holes MSAP may be formed by using a stepped drill.

Figure 15:
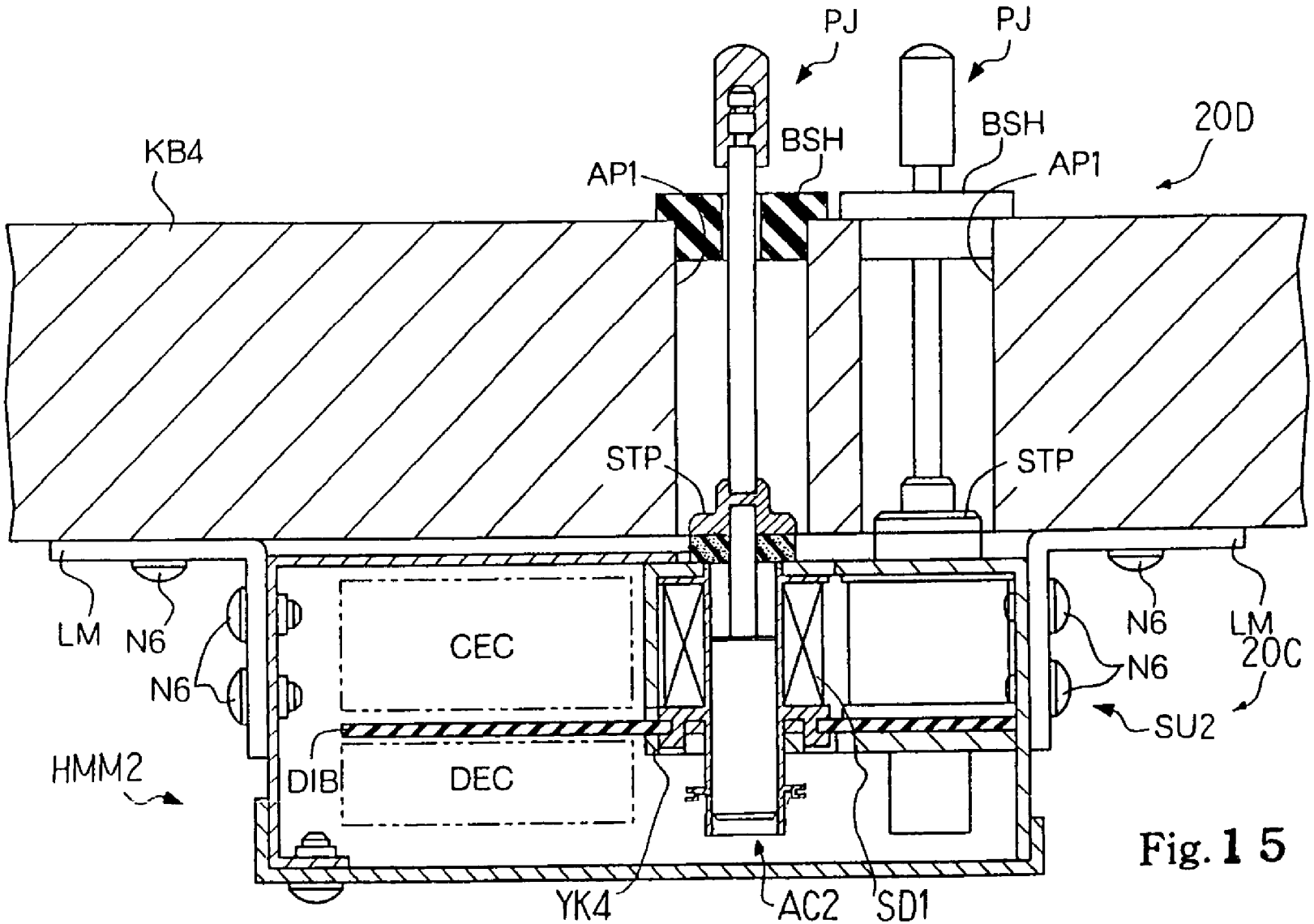
FIG. 15 is a cross sectional view showing bushes used for closing the plunger holes.

The plunger holes AP1 may be closed with bushes BSH as shown in FIG. 15. The bush BSH prevents the plunger hole AP1 from dust and contaminant.

Fourth Embodiment

Figure 16:
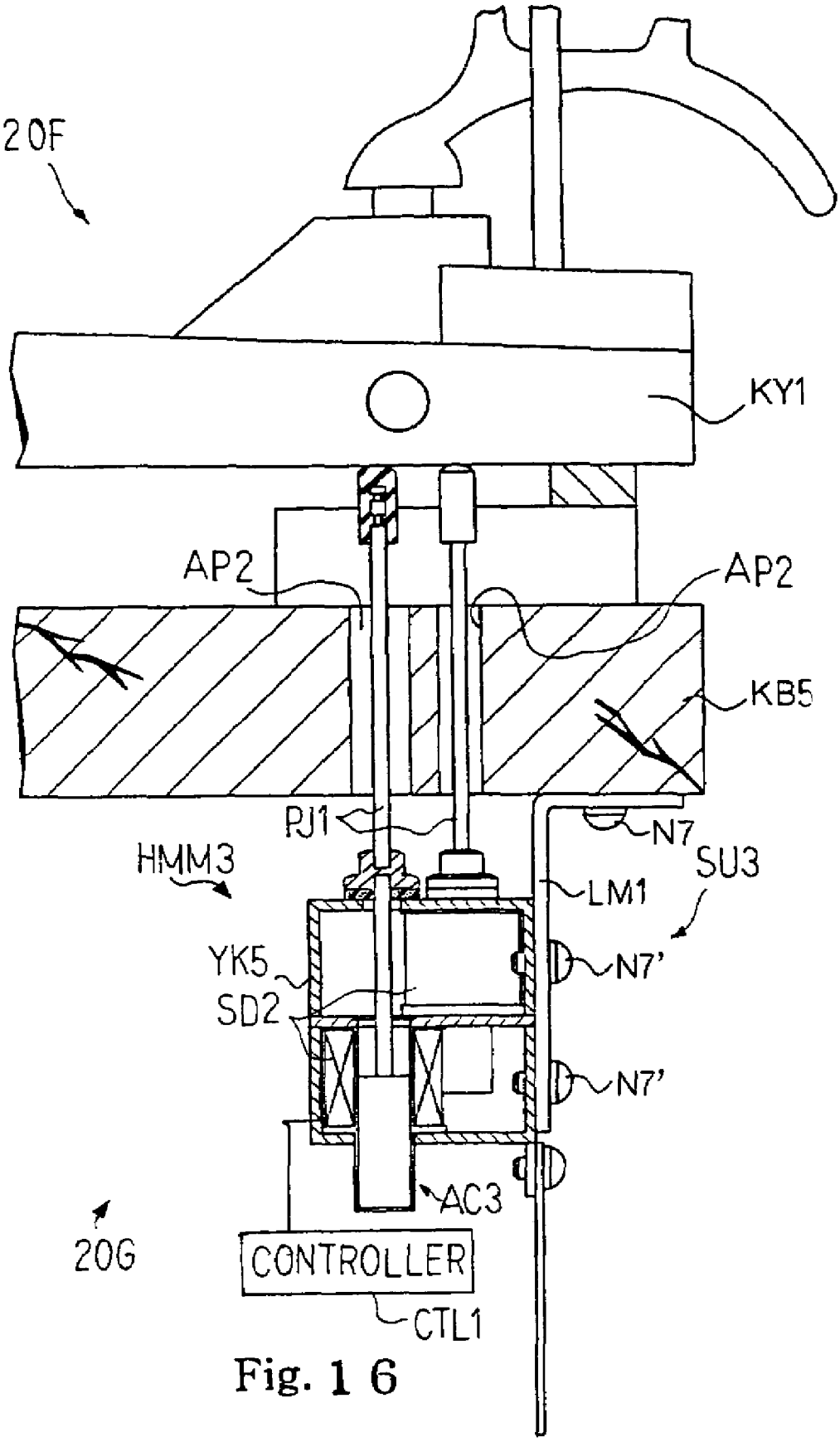
FIG. 16 is a cross sectional view showing the structure of still another automatic player piano according to the present invention.

FIG. 16 shows still another automatic player piano embodying the present invention. The automatic player piano implementing the fourth embodiment is fabricated on the basis of an upright piano 20F. In other words, the automatic player piano largely comprises the upright piano 20F and an automatic playing system 20G. The upright piano is well known to the skilled person, and no further description is hereinafter incorporated for the sake of simplicity. However, the black/white keys and key bed are labeled with references KY1 and KB5, respectively. The key bed KB5 is formed with plunger holes AP2. A rear portion is assigned to the plunger holes AP2, and the plunger holes AP2 are laterally arranged in a staggered manner. The plunger holes AP2 are respectively associated with the black/white keys KY1, and are open to the space under the associated black/white keys KY1.

The automatic playing system 20G includes an array HMM3 of solenoid-operated key actuators AC3, a supporting frame SU3 and a controller CTL1. The supporting frame SU3 is bolted to the reverse surface of the key bed KB5 by means of screws N7, and is hung from the key bed KB5. Yokes YK5 are shared among solenoids SD2. Plungers PJ1 are respectively associated with the solenoids SD2, and the plungers PJ1 are projectable from and retractable into the associated solenoids SD2. Plural plates SP3 (see FIG. 17A) form in combination the supporting frame SU3, and have respective flange portions, which are bolted to the reverse surface of the key bed KB5, and supporting positions LM1. The flange portions and supporting portions LM1 form an angle of 90 degrees so that the supporting portions LM1 downwardly extend from the reverse surface of the key bed KB5. The solenoid-operated key actuators AC3 are secured to the supporting portions LM1, and the solenoids SD2 are bolted to the supporting portions LM1 as follows.

Figure 17B:
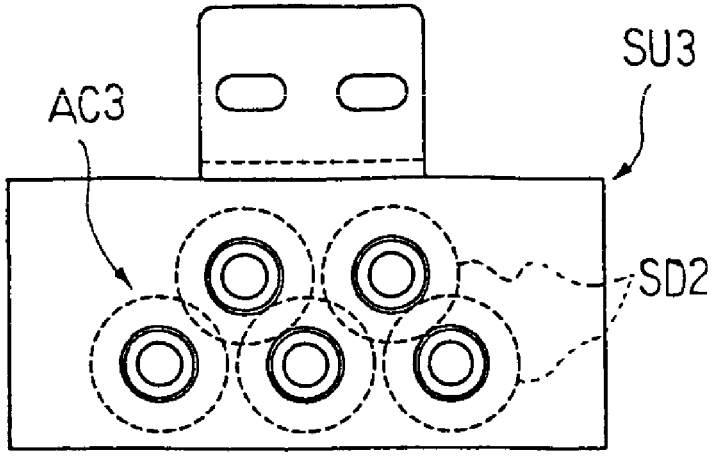
FIG. 17B is a plane view showing the arrangement of the solenoid-operated key actuators.
Figure 17A:
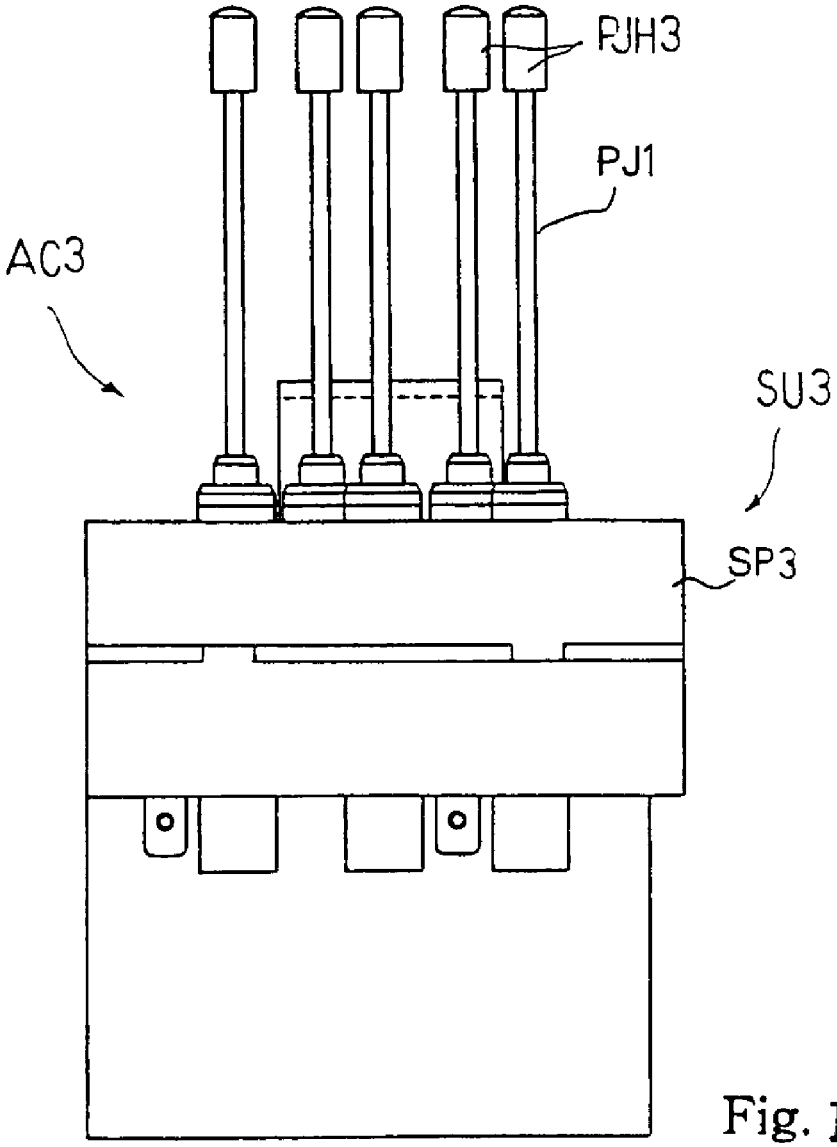
FIG. 17A is a front view showing an array of solenoid-operated key actuators incorporated in the automatic player piano.

The solenoid-operated key actuators AC3 are laterally arranged in the staggered manner, and form two rows (see FIG. 17B). The yokes YK5 of the solenoid-operated key actuators AC3 in the rear row are bolted to the upper portion of the supporting portions LM1 by means of screws N7', and the associated plungers PJ1 project upwardly. On the other hand, the yokes YK5 of the solenoid-operated key actuators AC3 in the front row are bolted to the lower portion of the supporting portions LM1, and the associated plungers PJ1 also project upwardly. Thus, the solenoids SD2 occupy the space under the key bed KB5, and the plungers PJ1 pass through the associated plunger holes AP2. The plungers PJ1 reach the space beneath the lower surfaces of the associated black/white keys KY1, respectively. Although the plungers PJ1 in the front row are longer than the plungers PJ1 in the rear row, the plunger heads PJH3 are equal in height (see FIG. 17A). The arrangement of the array HMM3 is preferable to the simple staggered arrangement, because the array HMM3 occupies a space narrower than the space occupied by the solenoid-operated key actuators AC2.

The controller CTL1 is connected to the solenoids SD2, and selectively energizes the solenoids SD2 so as to make the plungers PJ1 projecting therefrom. The automatic playing system 20G behaves in the similar manner to the automatic playing system 20B, and detailed description is omitted for avoiding repetition.

Figure 18:
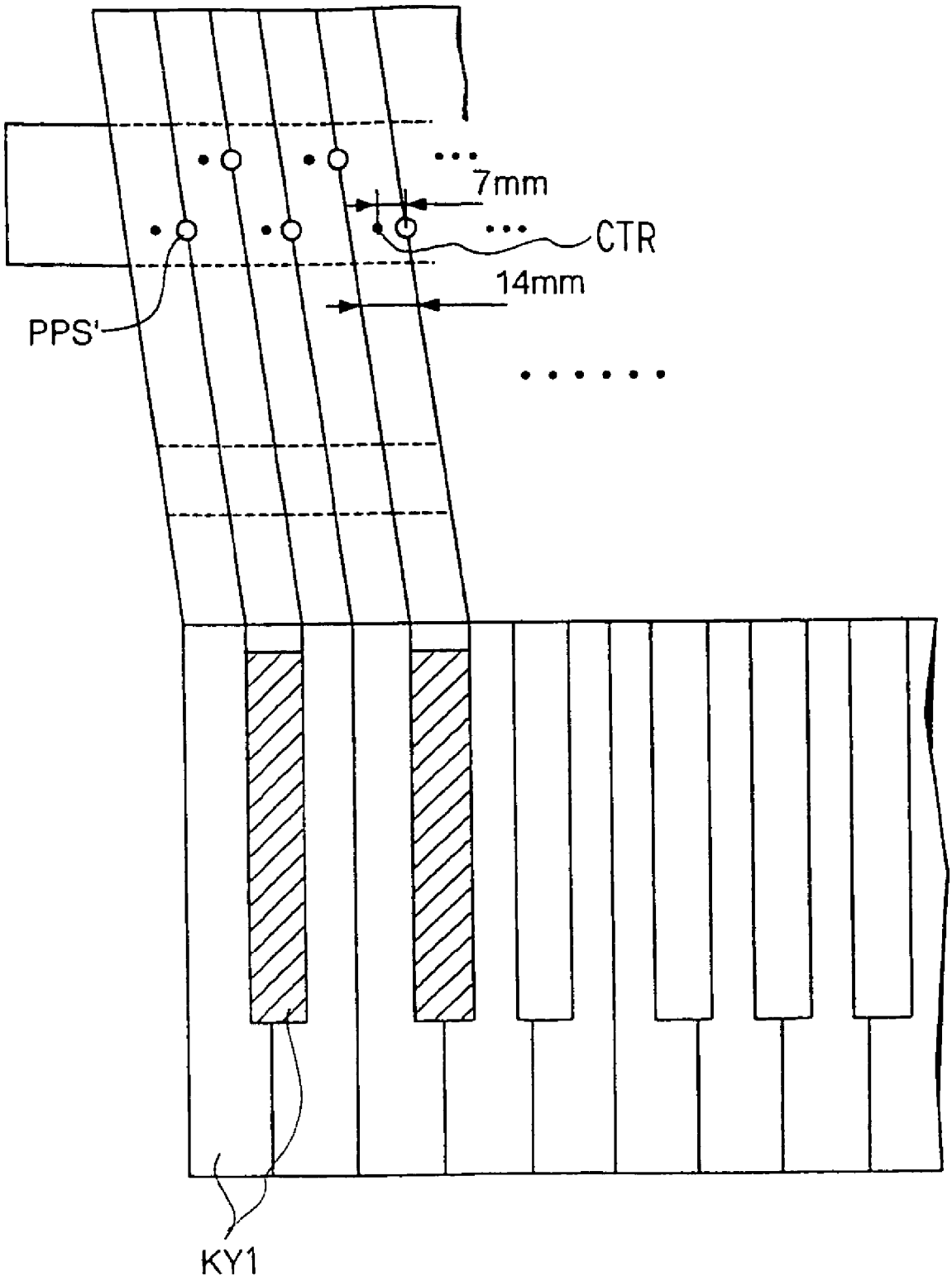
FIG. 18 is a plane view showing marks on the boundaries between every adjacent black/white keys in a retrofitting work.

An upright piano is retrofitted to the automatic player piano as similar to the grand piano. First, a worker puts marks PPS' on the boundaries between every adjacent two keys KY1 on a board or a sheet of paper as shown in FIG. 18. The black/white keys KY1 are assumed to be 14 millimeters in width. Then, the worker determines the centers CTR of the plunger holes AP2 at the intermediate point of the width. The worker drills the plunger holes AP2 with a suitable handy tool, and the solenoid-operated key actuators AC3, which have been already secured to the supporting frame SU3, are adjusted to the optimum position where the plungers PJ1 are respectively aligned with the associated plunger holes AP2.

Subsequently, the supporting frame SU3 is bolted to the key bed KB5 so that the array of solenoids SD2 are hung from the key bed KB5.

Finally, the controller CTL1 is connected to the solenoids SD2 through suitable lead wires.

As will be appreciated from the foregoing description, only the plunger holes AP/AP1/AP2 are required for the automatic playing system 20B, 20C and 20G. The plunger holes AP/AP1/AP2 do not make the mechanical strength seriously reduced. For this reason, the key beds KB1/KB2/KB3/KB4/KB5 are less warped, and the tuning work is not frequently required for the automatic player pianos.

Moreover, the plunger holes AP/AP1/AP2 are easily formed by using a handy tool such as, for example, a drill. Even though users request the manufacturer to retrofit acoustic pianos to the automatic player pianos, the workers carry the handy tools to the user's homes, and easily form the plunger holes AP/AP1/AP2 with the handy tool. This results in reduction of the retrofitting cost. Thus, the manufacture can expand the business.

Although particular embodiments of the present invention have been shown and described, it will be apparent to those skilled in the art that various changes and modifications may be made without departing from the spirit and scope of the present invention.

An acoustic piano may is equipped with a silent system together with the automatic playing system. The silent system includes a hammer stopper and an electronic tone generating sub-system. The hammer stopper is provided between the array of hammers HM and the strings 13, and is changed between a free position and a blocking position. The hammer stopper has an impact absorber. While the hammer stopper is staying at the free position, the impact absorber is out of the trajectories of the hammers HM, and the hammers HM strike the associated strings 13 at the end of the free rotation for generating the acoustic piano tones. When the hammer stopper is changed to the blocking position, the impact absorber enters the trajectories of the hammers HM. When the black/white key is depressed, the depressed key actuates the action unit, and causes the hammer HM to escape from the action unit. However, the hammer HM rebounds on the impact absorber on the way to the string, and rebounds thereon before striking the string. Thus, the hammer stopper at the blocking position prevents the strings from the hammers, and any acoustic tone is not generated from the strings. The electronic tone generating sub-system includes key sensors, a data processor and a tone generator. The data processor may be shared with the controller of the automatic playing system. The key sensors monitor the black and white keys, and periodically report the current key positions to the data processor. The data processor periodically analyzes the series of current key positions to see whether or not the pianist depresses the black and white keys. While the answer is given negative, the data processor waits for the fingering on the keyboard. On the other hand, when the data processor admits that the pianist depresses or releases a black and white key, the data processor produces music data codes representative of a note-on/note-off event, the key code and the velocity, and supplies the music data codes to the tone generator. The tone generator assigns a tone generating channel to the note-on event, and accesses a waveform memory. The tone generator produces a digital audio signal from the pieces of waveform data, and the digital audio signal is converted to the analog audio signal. The analog audio signal is supplied to a sound sub-system for converting it to electronic tones corresponding to the acoustic piano tones. Thus, the term "acoustic piano" does not mean only the standard grand/upright piano, and composite keyboard musical instruments such as the silent piano are fallen into the term "acoustic piano". Nevertheless, the acoustic piano does not set any limit to the present invention. The present invention is applicable to other sorts of keyboard musical instruments such as, for example, a harpsichord, an organ and a celesta.

The controller CTL may be mounted on the rigid circuit board DB together with the driver circuits DR. Otherwise, the rigid circuit board DB may be secured to a woody board of the piano case such as the key bed. In this instance, the actuator holder SU1 is formed with a hole, and the lead wires RS are connected to the coils CL through the hole.

The plunger holes AP may be as narrow as the cross section of the shaft portions PJS. In this instance, the plunger heads PJH are separated from the shaft portions PJS, and the actuator holders SU1 are lifted so as to make the plunger shafts PJS The bush BSH may be used in the other automatic player pianos.

The solenoid-operated key actuators do not set any limit to the technical scope of the present invention. An oil hydraulic system, in which an oil hydraulic pump and hydraulic actuators are incorporated, may be used in the automatic player system. Otherwise, a pneumatic system, in which a gas compressor and pneumatic actuators are incorporated, may be installed in the automatic playing system.

Words used in claims are correlated with the component parts of the above-described embodiments as follows. The grand piano 20A and upright piano 20F serve as an acoustic key board musical instrument, and the key beds KB1/KB2/KB3/KB4/KB5 are corresponding to a bottom board. The black/white keys KY/KY1, action units, hammers HA, dampers 12 and strings 13 as a whole constitute a tone generating mechanism. The solenoid-operated key actuators AC1/AC2/AC3 are corresponding to actuators. The solenoids SD1/SD2 serve as an energy converter. In fact, the solenoids convert the electric power to the magnetic force exerted on the plungers PJ/PJ1.

What is claimed is:

1. A method for retrofitting an acoustic keyboard musical instrument including a tone generating mechanism for producing tones and keys linked with said tone generating mechanism, movable over a bottom board and having certain end portions brought into contact with a rear rail extending on a first portion of said bottom board to an automatic player keyboard, the method comprising:

a) preparing a tool and an automatic playing system including a controller, an actuator holder and plural actuators having respective plungers and respective converters to be connected to said controller for converting a certain sort of energy to a force to be exerted on said plungers;

b) determining hole-forming portions of a second portion of said bottom board, said second portion being equal in thickness to the first portion, said bottom board having a surface from which a side wall extends;

c) forming holes through said hole-forming portions by using said tool;

d) moving said plural actuators to a space under said second portion of said bottom board;

e) aligning said plungers fitted to said actuator holder with said holes through an alignment work carried out, once;

f) lifting said plural actuators toward said bottom board so that said plungers are exposed to a space over said second portion of said bottom board through said holes, whereby said plungers get ready to exert force on said tone generating mechanism; and g) securing said actuator holder to said case so that said actuators are provided in said space below said second portion of said bottom board.

2. The method as set forth in claim 1, wherein determining hole-forming portions of a second portion of said bottom board includes b-1) putting marks indicative of boundaries between the keys of the acoustic keyboard musical instrument on a surface of a member inserted between said keys and said second portion of said bottom board;

b-2) calculating an intermediate point of each distance between the adjacent marks, and b-3) determining each of said hole-forming portions around said intermediate point.

3. The method as set forth in claim 1, in which said acoustic keyboard musical instrument is a grand piano so that said bottom board serves as a key bed of said grand piano.

4. The method as set forth in claim 1, in which said acoustic keyboard musical instrument is an upright piano so that said bottom board serves as a key bed of said upright piano.

5. The method as set forth in claim 1, in which each of said holes has a cross section wider than the widest cross section of associated one of said plungers.

* * * * *